US006439136B1

(12) United States Patent
Mann et al.

(10) Patent No.: US 6,439,136 B1
(45) Date of Patent: Aug. 27, 2002

(54) PULVERIZED SOLID FUEL NOZZLE TIP WITH CERAMIC COMPONENT

(75) Inventors: Jeffrey S. Mann, Windsor, CT (US); Ronald H. Nowak, E. Longmeadow, MA (US)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/899,008

(22) Filed: Jul. 3, 2001

(51) Int. Cl.[7] ..... F23D 1/00

(52) U.S. Cl. ..... 110/263; 110/265; 239/DIG. 19; 239/502

(58) Field of Search ..... 239/DIG. 19, 502, 239/587.4; 110/260, 261, 262, 263, 264, 265

(56) References Cited

U.S. PATENT DOCUMENTS 2,895,435 A * 7/1959 Bogot et al.
4,274,343 A * 6/1981 Kokkinos
4,520,739 A * 6/1985 McCartney et al.
4,828,184 A * 5/1989 Gardner et al.
5,249,535 A * 10/1993 Chung
5,483,906 A * 1/1996 Hufton
5,941,459 A * 8/1999 Brooker et al.
5,954,491 A * 9/1999 Helton et al.
6,089,171 A * 7/2000 Fong et al.
6,145,449 A * 11/2000 Kaneko et al.
6,152,052 A * 11/2000 Saxon et al.
6,196,142 B1 * 3/2001 Ohlsen

* cited by examiner

*Primary Examiner*—Ira S. Lazarus
*Assistant Examiner*—K. B. Reinehart
(74) *Attorney, Agent, or Firm*—Russell W. Warnock

(57) ABSTRACT

A (MRFC) solid fuel nozzle tip (12) that is particularly suited to being cooperatively associated with a pulverized solid fuel nozzle (34) of a firing system of the type employed in a pulverized solid fuel-fired furnace (10). The MRFC solid fuel nozzle tip (12) includes fuel air shroud means (46), primary air shroud means (48) located within the fuel air shroud means (46), fuel air shroud support means (50) operative for supporting the primary air shroud means (48) relative to the fuel air shroud means (46), and splitter plate means (52) mounted in supported relation within the primary air shroud means (48). The MRFC solid fuel nozzle tip (12) may be comprised of ceramics including silicon nitride, siliconized silicon carbide, mullite bonded silicon carbide alumina composite, and alumina zirconia composites.

8 Claims, 13 Drawing Sheets

PULVERIZED SOLID FUEL NOZZLE TIP WITH CERAMIC COMPONENT

BACKGROUND OF THE INVENTION

This invention relates to firing systems for use with pulverized solid fuel-fired furnaces, and more specifically, to a pulverized solid fuel nozzle tip with a ceramic component for use in such firing systems.

It has long been known in the prior art to employ pulverized solid fuel nozzle tips in firing systems of the type that are utilized in pulverized solid fuel-fired furnaces. By way of exemplification and not limitation in this regard, reference may be had to U.S. Pat. No. 2.895,435 entitled "Tilting Nozzle For Fuel Burner", which issued on Jul. 21, 1959 and which was assigned to the same assignee as the present patent application. In accordance with the teachings of U.S. Pat. No. 2,895,435, there is provided a tilting nozzle that is alleged to provide substantially uniform distribution of the fuel-air mixture leaving the tilting nozzle and substantially uniform velocity across the discharge opening of the tilting nozzle into the furnace. To this end, the tilting nozzle includes an inner conduit within an outer conduit. Moreover, a plurality of baffles or division walls are provided within the inner conduit arranged in planes substantially parallel to fluid flow and such as to divide the inner conduit into a multiplicity of parallel channels. These baffles or division walls are designed to be operative to correct the concentration of the air-fuel mixture along the deflecting wall of the inner conduit and the resulting relatively unequal pressure there when the titling nozzle is tilted. Thus, the effect is that as the tilting nozzle is tilted, either upwardly or downwardly, the unequal velocities through the tilting nozzle are made substantially equal by restricting the flow in the high pressure zone present at the inlet end of the inner conduit and encouraging the flow in the low pressure zone also present at the inlet end of the inner conduit.

Another prior art form of a pulverized solid fuel nozzle tip that has been employed in firing systems of the type that are utilized in pulverized solid fuel-fired furnaces is depicted in U.S. Pat. No. 4,274,343 entitled "Low Load Coal Nozzle", which issued on Jun. 23, 1981 and which is assigned to the same assignee as the present patent application. In accordance with the teachings of U.S. Pat. No. 4,274,343, there is provided a fuel-fired admission assembly of the type incorporating a split coal bucket having an upper and a lower coal nozzle pivotally mounted to the coal delivery pipe and independently tiltable of each other. Continuing, a plate is disposed along the longitudinal axis of the coal delivery pipe with its leading edge oriented across the inlet end of the coal delivery pipe so that that portion of the primary air pulverized coal stream having a high coal concentration enters the coal delivery pipe on one side of the plate and that portion of the primary air-pulverized coal stream having a low coal concentration enters the coal delivery pipe on one side of the plate and that portion of the primary air-pulverized coal stream having a low coal concentration enters the coal delivery pipe on the other side of the plate. Moreover, the trailing edge of the plate is orientated across the outlet end of the coal delivery pipe such that that portion of the primary air-pulverized coal stream having a high coal concentration is discharged from the coal delivery pipe through the upper coal nozzle and such that that portion of the primary air-pulverized coal stream having a low coal concentration is discharged from the coal delivery pipe through the lower coal nozzle.

Although the pulverized solid fuel nozzle tips that form the subject matter of the above-noted U.S. patents have been demonstrated to be operative for their intended purposes, there has nevertheless been evidenced in the prior art a need for such pulverized solid fuel nozzle tips to be further improved. In this regard, it has been found that pulverized solid fuel deposits, i.e., coal deposits, on and within the pulverized solid fuel, i.e., coal, nozzle tips are problematic from an operational standpoint. That is, such coal deposits on and within the coal nozzle tip have been found to lead to either premature or catastrophic coal nozzle tip failure, depending primarily upon the tenacity of the formed deposits and the rate at which the deposition occurs. To this end, deposition of coal on or within the coal nozzle tip is believed to be caused by a combination of the following three variables: 1) coal composition/type, i.e., slagging, non-slagging, sulfur/iron content, plasticity, etc.; 2) furance/coal nozzle operational settings, i.e., primary/fuel air flow rate/velocity, tilt position, firing rate, etc.; and 3) coal nozzle tip aerodynamics.

Thus, by way of summary, present designs, i.e., prior art forms, of coal nozzle tips have by and large been found to exacerbate the coal deposition problem through the creation of regions of low or negative velocities, i.e., recirculation, that cause slowly moving, "hot", coal particles to come in contact with "hot" coal nozzle tip metal surface. Namely, it has been found that as a result of this interaction, and under requisite thermal conditions that are related to the coal's plasticity, some of the coal particulate sticks to the plate, thus initiating the deposition process. Moreover, with specific reference to present designs, i.e., prior art forms, of coal nozzle tips, it has been found that regions of low and negative velocities typically occur along the thickness of the nozzle plane platework and in the sharp corners of the primary air shroud.

There has, therefrom, been evidenced in the prior art a need for a new and improved pulverized solid fuel nozzle tip that would address the deficiencies from which present designs, i.e., prior art forms of pulverized solid fuel nozzle tips have been found to suffer. Namely, there has been evidenced in the prior art a need for a new and improved pulverized solid fuel nozzle tip that would be advantageously characterized in the following respects: 1) would minimize low and negative, i.e., recirculation, velocity regions at the exit plane of the pulverized solid fuel nozzle tip, 2) would reduce available deposition surface on the pulverized solid fuel nozzle tip, and 3) would vary the nozzle tip/solid fuel nozzle thermal conditions to keep the "hot" solid fuel particulate matter from deposition on available metal platework surfaces of the pulverized solid fuel nozzle tip. Such a new and improved pulverized solid fuel nozzle tip accordingly would be effective in controlling the deposition phenomena, from which present designs, i.e., prior art forms, of pulverized solid fuel nozzle tips have been found to suffer. This would be accomplished through the aerodynamic design embodied by such a new and improved pulverized solid fuel nozzle tip coupled with proper adjustment of the controllable operational variables, i.e., fuel air flow rate, etc. As employed herein, the term "controllable" refers to the fact that solid fuel type and furnace load, and in some, notably retrofit, cases primary air flow rate are typically not controllable operational variables for mitigation of the deposition phenomena.

A common material composition for pulverized solid fuel nozzle tips is stainless steels, typically with relatively high temperature ratings such as, for example, 309 stainless steel. While stainless steel has the desirable material properties of ease of effort in incorporating it into the finished product, toughness, durability, high temperature strength, and ductility, certain material properties of conventional pulverized solid fuel nozzle tips comprised of stainless steel often force operators of pulverized solid fuel combustion facilitates to operate their facilities in a less than optimal economic manner to avoid exceeding the physical limits of such conventional pulverized solid fuel nozzle tips.

Two such limiting material properties are the ability of a stainless steel pulverized solid fuel nozzle tip to maintain its structural integrity at a high temperature (i.e., the maximum operating temperature) and the wear resistance of the pulverized solid fuel nozzle tip. A common maximum operating temperature for a stainless steel pulverized solid fuel nozzle tip is about 2100 degrees Fahrenheit (2100° F.) while it is not uncommon that the actual operating temperature of the pulverized solid fuel combustion facility can reach or exceed 2500 degrees Fahrenheit (2500° F.). Although there are design and operating approaches which are configured to prevent exposure of the pulverized solid fuel nozzle tip to the actual pulverized solid fuel combustion facility operating temperature such as, for example, providing cooling air within or around the pulverized solid fuel nozzle tip, there is still some risk that the pulverized solid fuel nozzle tip may nonetheless be exposed to temperatures above the recommended maximum operating temperature in spite of the use of such design and operating approaches. For example, in the event that the requisite cooling air which would normally be supplied to protect the pulverized solid fuel nozzle tip is, in fact, not supplied or is only inadequately supplied, the pulverized solid fuel nozzle tip may be exposed to temperatures greater than its recommended maximum operating temperature.

Excess exposure to temperatures beyond its recommended maximum operating temperature may cause a stainless steel pulverized solid fuel nozzle tip to fail during non-maintenance operation of the pulverized solid fuel combustion facility—in other words, at a time between regularly scheduled maintenance outages—whereupon the operation of the pulverized solid fuel combustion facility will be disrupted with consequent negative economic impact. The relatively modest wear resistance properties of the stainless steel in a stainless steel pulverized solid fuel nozzle tip may so compromise the pulverized solid fuel nozzle tip that the pulverized solid fuel nozzle tip fails between regularly scheduled maintenance outages, thus leading to the necessity of replacing the pulverized solid fuel nozzle tip at an unscheduled, economically disadvantageous time. While the wear resistance of a stainless steel pulverized solid fuel nozzle tip may be enhanced by measures such as, for example, coating the leading edges of the splitter plates of the pulverized solid fuel nozzle tip with a wear resistant material, such measures add to the manufacturing complexity and the weight of the thus treated pulverized solid fuel nozzle tip, thus detrimentally adding to the costs of the pulverized solid fuel nozzle tip.

In addition to those typical characteristics of a stainless steel pulverized solid fuel nozzle tip which may lead to catastrophic or unplanned operational failure, there are other characteristics of a stainless steel pulverized solid fuel nozzle tip which detract from the desirability of such pulverized solid fuel nozzle tips. For example, depending upon the pulverized solid fuel combustion facility and the type of pulverized solid fuel being combusted, a stainless steel pulverized solid fuel nozzle tip may experience slag build up attributable, in part, to the tendency of slag to bond to the surface of stainless steels. If the slag build up continues, the pulverized solid fuel nozzle tip may ultimately be completely blocked to through flow of the pulverized solid fuel.

To this end, such a new and improved pulverized solid fuel nozzle tip would be advantageously characterized by the fact that certain features were collectively embodied thereby. A first such feature is that the primary air shroud would be recessed. Recessing the primary air platework, i.e., primary air shroud, to within the exit plane of the fuel air shroud would remove this potential deposition surface from the firing zone, i.e., the exit plane of the nozzle tip, and would provide some cooling via the shielding effect of the fuel air shroud. Additionally, a shorter primary air plate, i.e., primary air shroud, would reduce the contact surface for heat transfer thereto and deposition thereon of coal particles. A second such feature is that the splitter plates would be recessed. Recessing the splitter plates along with the primary air shroud to within the exit plane of the fuel air shroud would remove this potential deposition surface from the firing zone, i.e., the exit plane of the nozzle tip, and would provide some cooling via the shielding effect of the fuel air shroud. Additionally, shorter splitter plates would reduce the contact surface for heat transfer thereto and deposition thereon of coal particles. A third such feature is that the fuel air shroud support ribs would be recessed. Recessing the fuel air shroud support ribs would keep the circulation region, and vertical deposition surface normally created by these devices at the exit of the nozzle tip from the firing zone, thus reducing their possible influence in the deposition process. Structurally, recessing the fuel air support ribs would also allow the front portions of the fuel air and primary air shrouds to independently expand reducing thermally induced stress. A fourth such feature is that the trailing edge of the primary air shroud would be tapered. Tapering the trailing edge of the primary air shroud would reduce the recirculation region created by the blunt faced trailing edge of present designs, i.e., prior art forms, of pulverized solid fuel nozzle tips. Such a recirculation region draws hot particulate matter back to the vertical plate surface creating or exacerbating the coal deposition phenomena. Also, such a recirculation region can provide conditions conducive to combustion, thus creating flames within the recirculation region, which raise temperatures and further exacerbate the deposition problem.

To this end, the primary air shroud platework would be tapered at a small enough angle such that neither the fuel air nor the primary air flows separate from the plate thus obviating the creation of additional, unwanted recirculation. A fifth such feature is that the splitter plate ends would be tapered. The splitter plate ends would be tapered to reduce the recirculation region created by the blunt faced trailing edge of present designs, i.e., prior art forms, of pulverized solid fuel nozzle tips, and the shed vortices created by the blunt faced leading edge of present designs, i.e., prior art forms, of pulverized solid fuel nozzle tips. As in the case of the blunt faced trailing edge of present designs, i.e., prior art forms, of pulverized solid fuel nozzle tips, the recirculation region induced by the blunt faced splitter plate of present designs, i.e., prior art forms, of pulverized solid fuel nozzle tips draws hot particulate back to the vertical plate surface creating or exacerbating the coal deposition phenomena. Also, such a recirculation region can provide conditions conducive to combustion, thus creating flames within the recirculation region, which raise temperatures and further exacerbate the deposition problem. In addition, the vortices induced by the blunt faced leading edge of present designs, i.e., prior art forms, of pulverized solid fuel nozzle tips increase turbulence levels within the primary stream thus exacerbating coal particulate deposition. To this end, the splitter plate edges would be tapered at a small enough angle to avoid primary air separation, which would create additional, unwanted flow recirculation. A sixth such feature is that the fuel air shroud would embody a bulbous inlet. The bulbous inlet of the fuel air shroud would minimize fuel air bypass of the fuel air shroud during tilt conditions which currently occurs with present designs, i.e., prior art forms, of pulverized solid fuel nozzle tips. Moreover, the bulbous inlet would enhance fuel air flow through the fuel air shroud thereby acting to both cool the nozzle tip platework, and thermally blanket the primary air/coal stream to delay ignition, which also provides a tip cooling effect. On the other hand, were the fuel air shroud flow to be allowed to drop severely due to tip bypass, low pressure/velocity regions could be created within the fuel air shroud, leading to reverse flow and particle deposition within this annular region. A seventh such feature is that the primary air shroud exit plane corners would be rounded. Rounding the primary air shroud exit plane corners increases the corner velocities with respect to that found in the ninety degree corners of present designs, i.e., prior art forms, of pulverized solid fuel nozzle tips. Increasing the corner velocities increases the erosion energy for air/coal flowing through this region to help remove active deposits, and otherwise avoid deposition. Also, the rounded corners decrease the available surface for heat transfer from the hot platework to the cooler air/coal mixture for a volume element of air/coal within the tip corner. An eighth such feature is that the fuel air shroud exit plane corners would be rounded. The rounded fuel air shroud exit plane corners, combined with the rounded primary air shroud exit plane corners, provide for higher corner velocities, thus minimizing low velocity regions on the fuel air shroud. In addition, the rounded fuel air shroud exit plane corners assist in achieving a uniform fuel air opening. A ninth such feature is that a uniform fuel air shroud opening (exit plane) would be provided. Providing a uniform fuel air shroud opening provides for uniform fuel air distribution within the nozzle tip. Namely, providing a uniform fuel air shroud opening provides for uniform nozzle tip cooling via the fuel air stream, but also provides for uniform blanketing of the primary air stream for control of ignition position and of $NO_X$ emissions. A tenth such feature is that for certain applications wherein minimum $NO_X$ emissions and/or minimum carbon in the flyash are criteria that need to be met, it would be possible to provide a version of such a new and improved pulverized solid fuel nozzle tip embodying collectively all of the nine features that have been enumerated hereinabove, which would enable minimum $NO_X$ emissions and/or minimum carbon in the flyash to be realized, while yet thereby enabling there to be realized concomitantly therewith minimum fuel deposition and therethrough avoidance of pulverized solid fuel nozzle tip failure occasioned thereby. Moreover, such minimization of $NO_X$ emissions and/or minimization of carbon in the flyash would be attainable by providing a version of such a new and improved pulverized solid fuel nozzle tip wherein one or more bluff bodies, each embodying a predefined geometry, are suitably supported in mounted relation at a predetermined location therewithin.

Moreover, irrespective of the dimensions or configuration of the pulverized solid fuel nozzle tip, including the presence or absence of features such as a predetermined recessed spacing of the primary air shroud from the exit plane of the nozzle tip, a tapered profile of the primary air shroud platework, or primary air shroud exit plane rounded corners, a new and improved pulverized solid fuel nozzle tip would be characterized by the fact that it comprises a ceramic material such as, for example, silicon nitride, siliconized silicon carbide (having a silicon content of between about twenty percent (20%) to sixty percent (60%) by weight, mullite bonded silicon carbide alumina composite, and alumina zirconia composites.

SUMMARY OF THE PRESENT INVENTION

It is, therefore, an object of the present invention to provide a new and improved solid fuel nozzle tip for use in a firing system of the type utilized in pulverized solid fuel-fired furnaces.

It is a further object of the present invention to provide such a new and improved solid fuel nozzle tip for use in a firing system of the type utilized in a pulverized solid fuel-fired furnace that is comprised of a ceramic material.

It is yet another object of the present invention to provided such a new and improved solid fuel nozzle tip for use in a firing system of the type utilized in a pulverized solid fuel-fired furnace that is comprised of a ceramic material from the group of ceramic materials including silicon nitride, siliconized silicon carbide (having a silicon content of between about twenty percent (20%) to sixty percent (60%) by weight, mullite bonded silicon carbide alumina composite, and alumina zirconia composites.

It is another object of the present invention to provide such a new and improved MRFC solid fuel nozzle tip for use in a firing system of the type utilized in a pulverized solid fuel-fired furnace that is characterized in that the primary air shroud thereof is recessed.

Yet still another object of the present invention is to provide such a new and improved MRFC solid fuel nozzle tip for use in a firing system of the type utilized in a pulverized solid fuel-fired furnace that is characterized in that for purposes of attaining therewith minimum $NO_X$ emissions and/or minimum carbon in the flyash one or more bluff bodies, each embodying a predefined geometry, are suitably supported in mounted relation at a predetermined location therewithin.

In accordance with one embodiment of the present invention there is provided a solid fuel nozzle tip for use in a firing system of the type utilized in a pulverized solid fuel-fired furnace. The subject solid fuel nozzle tip, in accordance with this one embodiment of the present invention, is constructed so as to be capable of operation as a minimum recirculation flame control (MRFC) solid fuel nozzle tip. To this end, the subject MRFC solid fuel nozzle tip is streamlined aerodynamically to prevent low or negative velocities at the exit of the MRFC solid fuel nozzle tip, which otherwise could provide sites for the deposition thereat of solid fuel particles. As such, the subject MRFC solid fuel nozzle tip is thus effective in eliminating field problems, which heretofore have existed and which have been occasioned by the fact that solid fuel nozzle tip deposits have occurred when certain "bad slagging" solid fuel types, i.e., those having high sulfur/iron content are being fired. Such field problems, in turn, have ultimately resulted in premature failure of the solid fuel nozzle tips embodying prior art forms of construction.

The nature of the construction of the subject MRFC solid fuel nozzle tip, in accordance with this one embodiment thereof, is such that the subject MRFC solid fuel nozzle tip includes fuel air shroud means, primary air shroud means located within the fuel air shroud means, fuel air shroud support means operative for supporting the primary air shroud means within the fuel air shroud means, and splitter plate means mounted in supported relation within the primary air shroud means. The fuel air shroud means embodies a bulbous configuration at the inlet thereof whereby bypassing of the fuel air around the fuel air shroud means during tilt conditions is minimized and whereby the cooling effect of the fuel air flow through the fuel air shroud means is enhanced. In addition at the exit end thereof the fuel air shroud means embodies rounded corners that in turn provide for higher corner velocities thus minimizing low velocity regions on the fuel air shroud means whereat solid fuel particle deposition could occur. With regard to the primary air shroud means, the primary air shroud means at the exit plane thereof is recessed to within the exit plane of the fuel air shroud means whereby the exit plane of the primary air shroud means is removed as a potential deposition surface for solid fuel particles. In addition, the primary air shroud means embodies a tapered trailing edge that is operative to reduce the recirculation region at the trailing edge of the primary air shroud means that might otherwise be operative to draw hot particulate matter back to the trailing edge surface of the primary air shroud means and thereby create or exacerbate thereat the solid fuel particle deposition phenomena. The primary air shroud also embodies rounded exit plane corners that operate to increase velocities in the corners that in turn assist in helping to avoid deposition of solid fuel particles thereat, and in the event such deposition does occur helps in effecting the removal thereof. In addition, the rounded exit plane corners of the primary air shroud means coupled with the rounded exit plane corners of the fuel air shroud means provide the subject MRFC solid fuel nozzle tip with a uniform fuel air shroud opening, which in turn provides for uniform fuel air flow distribution within the subject NRFC solid fuel nozzle tip. Next, as regards the fuel air shroud support means, the fuel air shroud support means is recessed relative to the exit plane of the MRFC solid fuel nozzle tip so as to keep the recirculation region and vehicle deposition surface normally created thereby away from the exit plane of the MRFC solid fuel nozzle tip, thus reducing the fuel air shroud support means' possible influence in the deposition process. Further, structurally, recessing the fuel air shroud support means also allows the front portion of the fuel air shroud means and the front portion of the primary air shroud means to independently expand and thereby reduce thermally induced stress. Lastly, insofar as the splitter plate means is concerned, the splitter plate means along with the primary air shroud means is recessed, reference having been made hereinbefore to the recessing of the primary air shroud means, to within the exit plane of the fuel air shroud means thereby removing the splitter plate means as well as the primary air shroud as surfaces susceptible to potential depositions arising from the firing zone, i.e., the exit plane of the MRFC solid fuel nozzle tip. Also, such recessing is effective for purposes of providing some cooling via the shielding effect provided by the fuel air shroud means. In addition, such recessing of the splitter plate means results in a shorter splitter plate means thereby reducing the contact surface for heat transfer thereto as well as the contact surface for the deposition of solid fuel particles thereon. Furthermore, the ends of the splitter plate means are tapered but at a small enough angle to avoid primary air separation, which cause the creation of additional unwanted flow recirculation. Such tapering of the ends of the splitter plate means is effective in reducing the recirculation region that has served to adversely affect the operation of prior art forms of solid fuel nozzle tips, which are characterized by the fact that they embody a blunt faced trailing edge, and in reducing the shed vortices that are created by such blunt faced trailing edges. If the splitter plate means were to embody blunt ends, the recirculation region induced thereby would operate to draw hot particulate back thereto and thus would have the effect of creating or exacerbating the solid fuel deposition phenomena. Such a recirculation region is also capable of providing conditions conducive to combustion, thus creating flames within the recirculation region, which would have the effect of raising temperatures and further exacerbating the deposition problem. Moreover, leading edge induced vortices created by blunt faced edges occasion increased turbulence levels within the primary air stream and thus exacerbate solid fuel particulate deposition on such edges, a result that is obviated when tapered edges are employed rather than blunt edges.

DESCRIPTION OF THE PREFERRED EMBODIMENT

Figure 1:
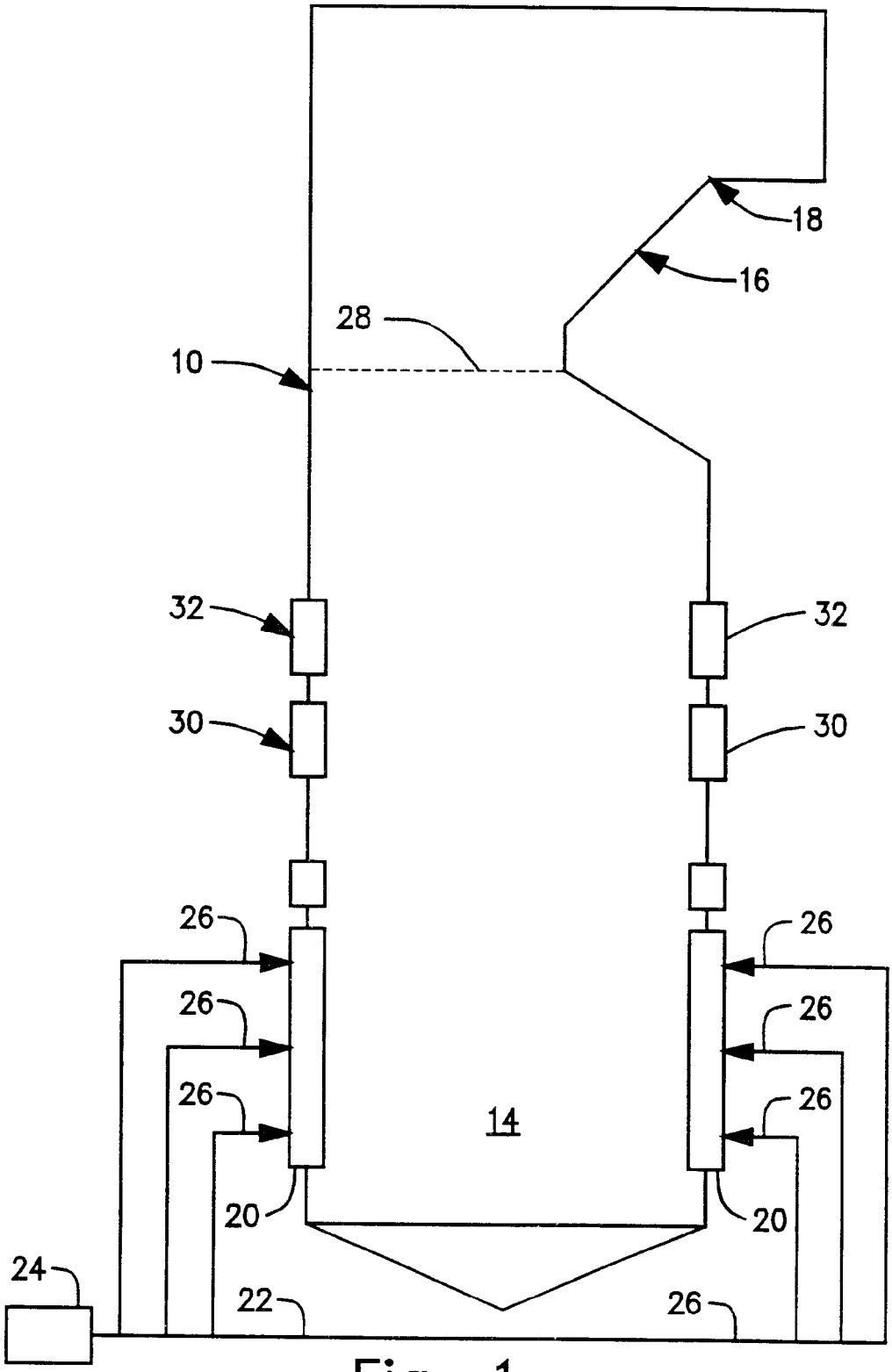
FIG. 1 is a diagrammatic representation in the nature of a vertical sectional view of a pulverized solid fuel-fired furnace embodying a firing system with which a minimum recirculation flame control (MRFC) solid fuel nozzle tip construction in accordance with the present invention may be utilized.

Referring now to the drawing, and more particularly to FIG. 1 thereof, there is depicted therein a pulverized solid fuel-fired furnace, generally designated by reference numeral (10). Inasmuch as the nature of the construction and the mode of operation of pulverized solid fuel-fired furnaces per se are well known to those skilled in the art, it is not deemed necessary, therefore, to set forth herein a detailed description of the pulverized solid fuel-fired furnace (10) illustrated in FIG. 1. Rather, for purposes of obtaining an understanding of a pulverized solid fuel-fired furnace (10) in the firing system of which a minimum recirculation flame control (MRFC) solid fuel nozzle tip constructed in accordance with the present invention, a first embodiment thereof being generally designated by the reference numeral (12) in FIGS. 3 and 4 of the drawing, is particularly suited for employment, it is deemed to be sufficient that there be presented herein merely a description of the nature of the components of the pulverized solid fuel-fired furnace (10) and of the components of the firing system with which the pulverized solid fuel-fired furnace (10) is suitably provided and with which the MRFC solid fuel nozzle tip cooperates. For a more detailed description of the nature of the construction and the mode of operation of the components of the pulverized solid fuel-fired furnace (10) and of the firing system with which the pulverized solid fuel-fired furnace (10) is suitably provided, which are not described herein, one may have reference to the prior art, i.e., in the case of the pulverized solid fuel-fired furnace (10) to U.S. Pat. No. 4,719,587, which issued Jan. 12, 1988 to F. J. Berte and which is assigned to the same assignee as the present patent application and, in the case of the firing system with which the pulverized solid fuel-fired furnace (10) is suitably provided, to U.S. Pat. No. 5,315,939, which issued May 31, 1994 to M. J. Rini et al. and which is assigned to the same assignee as the present patent application.

Referring further to FIG. 1 of the drawing, the pulverized solid fuel-fired furnace (10) as illustrated therein includes a burner region, generally designated by the reference numeral (14). It is within the burner region (14) of the pulverized solid fuel-fired furnace (10) that in a manner well-known to those skilled in this art combustion of the pulverized solid fuel and air is initiated. The hot gases that are produced from combustion of the pulverized solid fuel and air rise upwardly in the pulverized solid fuel-fired furnace (10). During the upwardly movement thereof in the pulverized solid fuel-fired furnace (10), the hot gases in a manner well-known to those skilled in this art give up heat to the fluid passing through the tubes (not shown in the interest of maintaining clarity of illustration in the drawing) that in conventional fashion line all four of the walls of the pulverized solid fuel-fired furnace (10). Then, the hot gases exit the pulverized solid fuel-fired furnace (10) through the horizontal pass, generally designated by the reference numeral (16), of the pulverized solid fuel-fired furnace (10), which in turn leads to the rear gas pass, generally designated by the reference numeral (18), of the pulverized solid fuel-fired furnace (10). Both the horizontal pass (16) and the rear gas pass (18) commonly contain other heat exchanger surface (not shown) for generating and superheating steam, in a manner well-known to those skilled in this art. Thereafter, the steam commonly is made to flow to a turbine (not shown), which forms one component of a turbine/generator set (not shown), such that the steam provides the motive power to drive the turbine (not shown) and thereby also the generator (not shown), which in know fashion is cooperatively associated with the turbine, such that electricity is thus produced from the generator (not shown).

With the preceding by way of background, reference is once again had to FIG. 1 of the drawing for purposes of setting forth herein a description of the nature of the construction and the mode of operation of the firing system with which the pulverized solid fuel-fired furnace (10), depicted in FIG. 1 of the drawing, is suitably provided. Continuing, the subject firing system as seen with reference to FIG. 1 of the drawing includes a housing preferably in the form of a main windbox, which is identified in FIG. 1 by the reference numeral (20). In a manner well-known to those skilled in the art, the windbox (20) in known fashion is provided with a plurality of air compartments (not shown) through which air supplied from a suitable source thereof (not shown) is injected into the burner region (14) of the pulverized solid fuel-fired furnace (10). In addition, the windbox (20) in a manner well-known to those skilled in the art is provided with a plurality of fuel compartments (not shown) through which solid fuel is injected into the burner region (14) of the pulverized solid fuel-fired furnace (10). The solid fuel, which is injected through the aforereferenced plurality of fuel compartments (not shown), is supplied to this plurality of fuel compartments (not shown) by means of a pulverized solid fuel supply means, denoted generally by the reference numeral (22) in FIG. 1 of the drawing. To this end, the pulverized solid fuel supply means (22) includes a pulverizer, denoted generally by the reference numeral (24) in FIG. 1, and a plurality of pulverized solid fuel ducts, denoted in FIG. 1 by the reference numeral (26). In a fashion well-known to those skilled in the art, the pulverized solid fuel is transported through the pulverized solid fuel ducts (26) from the pulverizer (24) to which the pulverized solid fuel ducts (26) are connected in fluid flow relation to the previously mentioned plurality of fuel compartments (not shown) to which the pulverized solid fuel ducts (26) are also connected in fluid flow relation. Although not shown in the interest of maintaining clarity of illustration in the drawing, the pulverizer (24) is operatively connected to a fan (not shown), which in turn is operatively connected in fluid flow relation with the previously mentioned plurality of air compartments (not shown), such that air is supplied from the fan (not shown) to not only the aforesaid plurality of air compartments (not shown) but also to the pulverizer (24) whereby the pulverized solid fuel supplied from the pulverizer (24) to the aforesaid plurality of fuel compartments (not shown) is transported through the pulverized solid fuel ducts (26) in an air stream in a manner which is well known to those skilled in the art of pulverizers.

In further regard to the nature of the firing system with which the pulverized solid fuel-fired furnace (10), which is illustrated in FIG. 1 of the drawing, is suitably provided, two or more discrete levels of separated overfire air are incorporated in each corner of the pulverized solid fuel-fired furnace (10) so as to be located between the top of the main windbox (20) and the furnace outlet plane, depicted by the dotted line (28) in FIG. 1, of the pulverized solid fuel-fired furnace (10). To this end, in accordance with the illustration of the pulverized solid fuel-fired furnace (10) in FIG. 1 of the drawing, the firing system with which the pulverized solid fuel-fired furnace (10) is suitably provided embodies two or more discrete levels of separated overfire air, i.e., a low level of separated overfire air denoted generally in FIG. 1 of the drawing by the reference numeral (30) and a high level of separated overfire air denoted generally in FIG. 1 of the drawing by the reference numeral (32). The low level (30) of separated overfire air is suitably supported through the use of any conventional form of support means (not shown) suitable for use for such a purpose within the burner region (14) of the pulverized solid fuel-fired furnace (10) so as to be suitably spaced from the top of the windbox (20), and so as to be substantially aligned with the longitudinal axis of the main windbox (20). Similarly, the high level (32) of separated overfire air is suitably supported through the use of any conventional form of support means (not shown) suitable for use for such a purpose within the burner region (14) of the pulverized solid fuel-fired furnace (10) so as to be suitably spaced from the low level (30) of separated overfire air, and so as to be substantially aligned with the longitudinal axis of the main windbox (20). The low level (30) of separated overfire air and the high level (32) of separated overfire air are suitably located between the top of the main windbox (20) and the furnace outlet plane (28) such that it will take the gases generated from the combustion of the pulverized solid fuel a preestablished amount of time to travel from the top of the main windbox (20) to the top of the high level (32) of separated overfire air.

Figure 2:
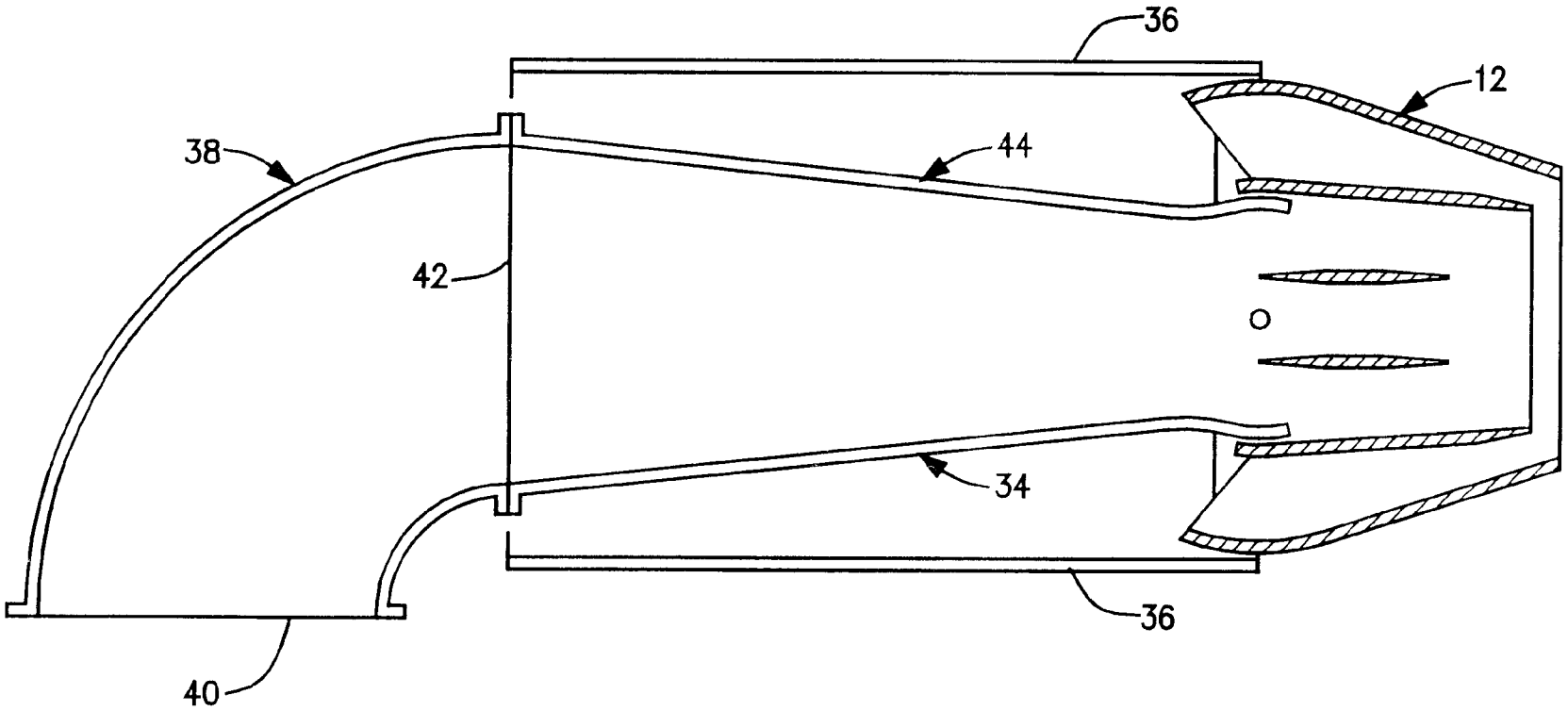
FIG. 2 is a side elevational view of a pulverized solid fuel nozzle, which is illustrated in FIG. 2 embodying a first embodiment of a minimum recirculation flame control (MRFC) solid fuel nozzle tip construction in accordance with the present invention, of the type employed in the firing system of the pulverized solid fuel-fired furnace that is illustrated in FIG. 1.

Referring next to FIG. 2 of the drawing, there is depicted therein a pulverized solid fuel nozzle, denoted generally therein by the reference numeral (34). In accordance with the illustration thereof in FIG. 2 of the drawing, the pulverized solid fuel nozzle (34) is depicted as embodying a first embodiment of a MRFC solid fuel nozzle tip (12) constructed in accordance with the present invention. A pulverized solid fuel nozzle (34), in a manner well-known to those skilled in the art, is suitably supported in mounted relation within each of the plurality of fuel compartments (not shown) to which reference has been had hereinbefore. In this regard, a schematic representation of one of the plurality of fuel compartments (not shown) is denoted in FIG. 2 by the reference numeral (36).

Any conventional form of mounting means suitable for use for such a purpose may be employed to mount the pulverized solid fuel nozzle (34) in the fuel compartment (36). The pulverized solid fuel nozzle (34), as best understood with reference to FIG. 2 of the drawing, includes an elbow-like portion denoted generally in FIG. 2 by the reference numeral (38) that is designed, although it has not been depicted in FIG. 2 in the interest of maintaining clarity of illustration therewithin, to be operatively connected at one end, i.e., the end thereof denoted in FIG. 2 by the reference numeral (40), to a pulverized solid fuel duct (26). The other end, i.e., that denoted by the reference numeral (42), of the elbow-like portion (38), as seen with reference to FIG. 2 of the drawing, is operatively connected through the use of any conventional form of fastening means suitable for use for such a purpose to the longitudinally extending portion, denoted generally in FIG. 2 by the reference numeral (44). The length of the longitudinally extending portion (44) is such as to essentially correspond to the depth of the fuel compartment (36). The pulverized solid fuel nozzle (34), as has been set forth herein previously, embodies a first embodiment of a MRFC solid fuel nozzle tip (12), the nature of the construction and the mode of operation of which will be described herein in greater detail subsequently.

For purposes of setting forth herein a description of the nature of the construction and the mode of operation of the MRFC solid fuel nozzle tip (12), reference will be had to FIGS. 3–8 of the drawing. As has been stated hereinbefore the MRFC solid fuel nozzle tip (12) constructed in accordance with the present invention is advantageously characterized, by way of exemplification and not limitation, in each of the following respects. Namely, by virtue of the nature of the construction and the mode of operation of the MRFC solid fuel nozzle tip (12), low and negative, i.e., recirculation, velocity regions at the exit plane of the MRFC solid fuel nozzle tip (12) are minimized; available deposition surface on the MRFC solid fuel nozzle tip (12) is reduced; the nozzle tip/solid fuel nozzle thermal conditions can be varied to keep the "hot" particulate matter from depositing on available metal platework surfaces of the MRFC solid fuel nozzle tip (12); and it is possible therewith to achieve concomitantly with the foregoing minimum $NO_X$ emissions and/or minimum carbon in the flyash.

Figure 3:
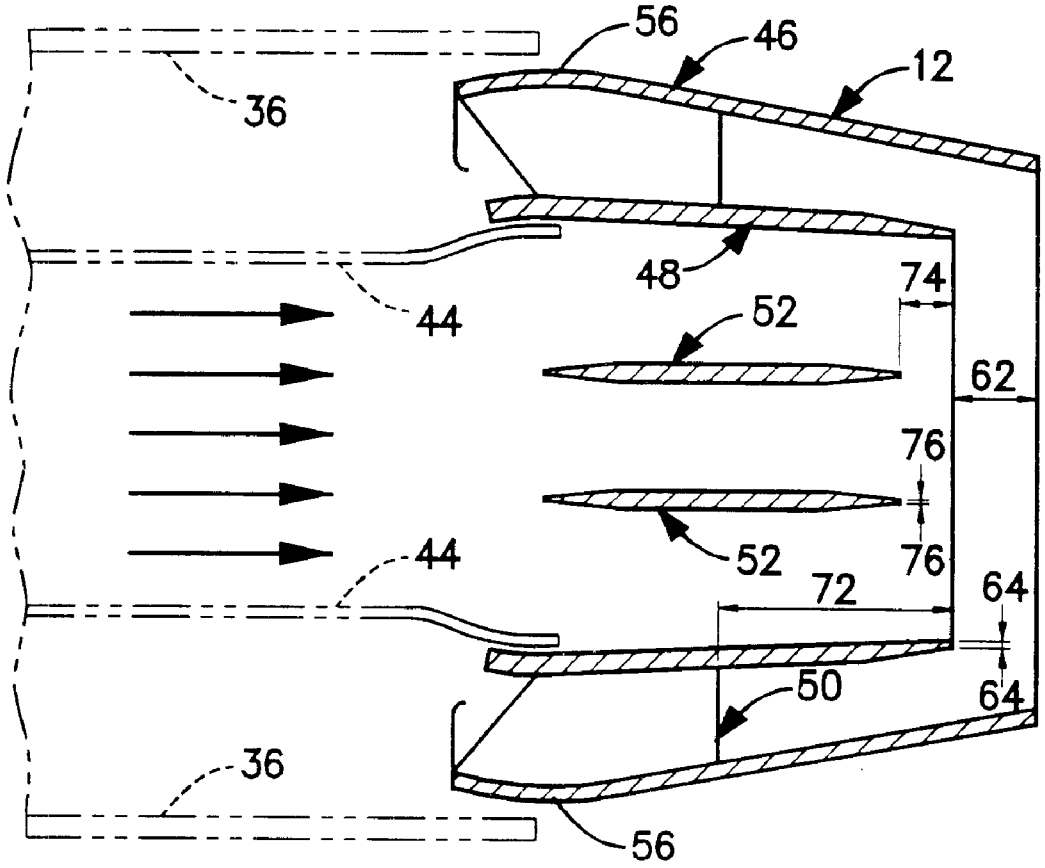
FIG. 3 is a side elevational view with parts broken away of the first embodiment of a minimum recirculation flame control (MRFC) solid fuel nozzle tip constructed in accordance with the present invention that is illustrated in FIG. 2.
Figure 4:
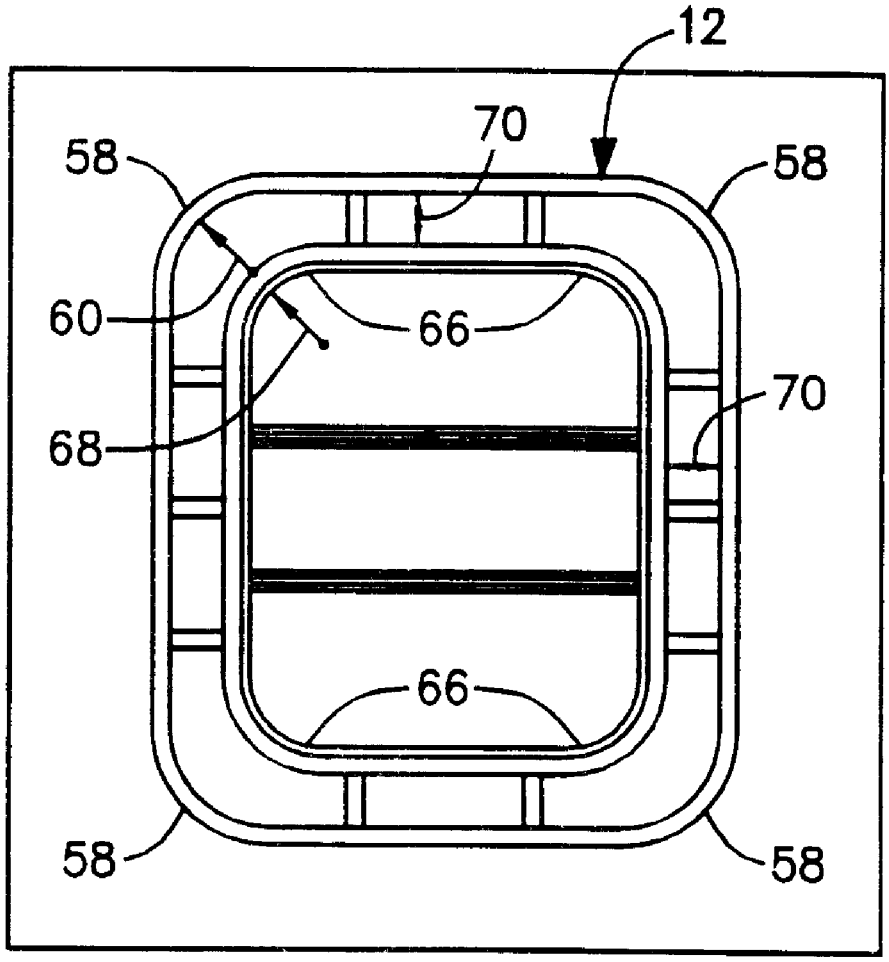
FIG. 4 is an end view of the first embodiment of a minimum recirculation flame control (MRFC) solid fuel nozzle tip constructed in accordance with the present invention that is illustrated in FIG. 2.
Figure 5:
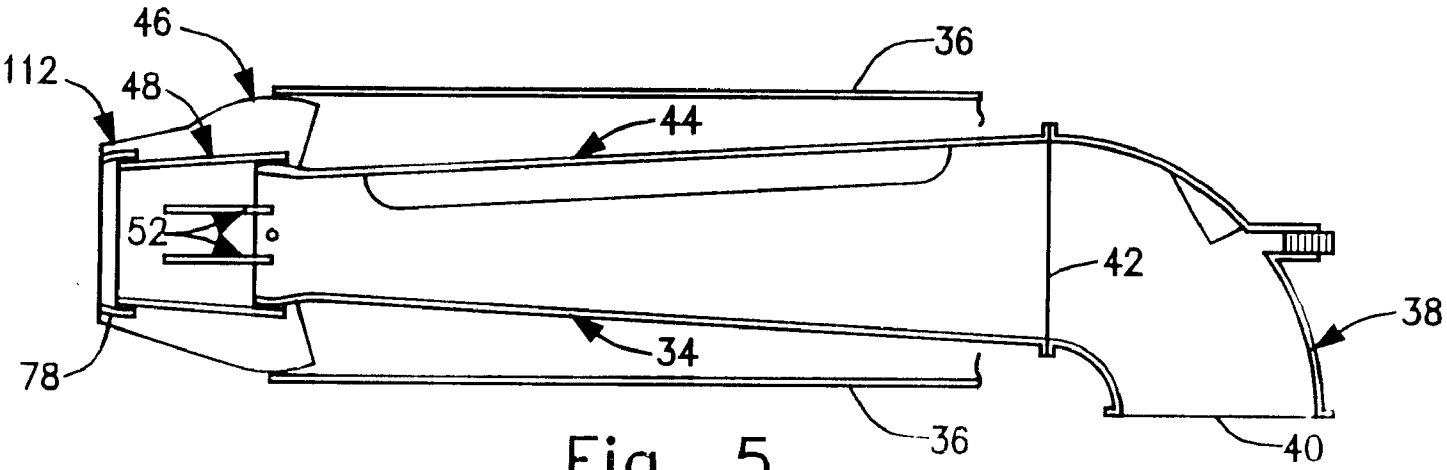
FIG. 5 is a side elevational view of a pulverized solid fuel nozzle, which is illustrated in FIG. 5 as embodying a first form of a second embodiment of a minimum recirculation flame control (MRFC) solid fuel nozzle tip constructed in accordance with the present invention, of the type employed in the firing system of the pulverized solid fuel-fired furnace illustrated in FIG. 1.

There are four embodiments of the MRFC solid fuel nozzle tip (12) constructed in accordance with the present invention that are described and illustrated in the instant application. The first of these four embodiments can be found depicted in FIGS. 2, 3 and 4 of the drawing. Reference will be had in particular to FIGS. 3 and 4 of the drawing for purposes of setting forth herein a description of the nature of the construction and the mode of operation of the first embodiment of the MRFC solid fuel nozzle tip (12), which for ease of reference herein will be deemed to be identified also by the reference numeral (12). Thus, as will be best understood with reference to FIGS. 3 and 4 of the drawing the first embodiment of the MRFC solid fuel nozzle tip (12) includes fuel air shroud means, denoted therein generally by the reference numeral (46); primary air shroud means, denoted therein generally by the reference numeral (48); fuel air shroud support means, denoted therein generally by the reference numeral (50); and splitter plate means, denoted therein generally by the reference numeral (52). To facilitate the acquiring of an understanding of the nature of the construction and the mode of operation of the first embodiment of the MRFC solid fuel nozzle tip (12), there is schematically depicted in FIG. 3 of the drawing through the use of dotted lines, a schematic representation seen at (36) of a portion of a fuel compartment and a schematic representation seen at (44) of the longitudinally extending portion of the pulverized solid fuel nozzle (34). Note is further made herein at this time to the fact that the direction of flow of the primary air and pulverized solid fuel to the first embodiment of the MRFC solid fuel nozzle tip (12) is depicted in FIG. 3 of the drawing through the use of the arrows, which are identified therein by means of the reference numeral (54).

Continuing, the fuel air shroud means (46), as best understood with reference to FIG. 3 of the drawing, embodies at the inlet end thereof a bulbous configuration identified by the reference numeral (56). The bulbous configuration (56) is operative to minimize the possibility that fuel air will bypass the fuel air shroud means (46), i.e., will not flow through the fuel air shroud means (46) as intended, particularly under tilt conditions, i.e., when the fuel air shroud means (46) is an upwardly tilt position or a downwardly tilt position relative to the centerline of the MRFC solid fuel nozzle tip (12). Should fuel air bypass the fuel air shroud means (46) this also has the concomitant effect of adversely impacting the extend to which the fuel air is capable of carrying out the cooling effect on the fuel air shroud means (46) desired therefrom. In addition to the bulbous configuration (56) thereof, the fuel air shroud means (46) is further characterized by the embodiment therein of rounded corners, denoted in FIG. 4 of the drawing by the reference numeral (58). Namely, for a purpose to which further reference will be had herein each of the rounded corners (58) of the fuel air shroud means (46) is made to embody the same predetermined radius, which for ease of reference thereto is depicted by the arrow identified by the reference numeral (60) in FIG. 4 of the drawing. The rounded corners (58) of the fuel air shroud means (46) operate to provide higher velocities in the corners of the fuel air shroud means (46), which in turn effectively minimize the existence of low velocity regions on the fuel air shroud means (46) that might otherwise lead to unwanted solid fuel deposition.

A description will next be had herein of the nature of the construction and the mode of operation of the primary air shroud means (48) of the first embodiment of the MRFC solid fuel nozzle tip (12). For this purpose reference will once again be had to FIGS. 3 and 4 of the drawing. The primary air shroud means (48), as will be best understood with reference to FIG. 3 of the drawing, is characterized in a first respect by the fact that the trailing edge of the primary air shroud means (48) is recessed relative to the trailing edge of the fuel air shroud means (46) by a predetermined distance. This predetermined distance is depicted in FIG. 3 of the drawing by the arrow identified therein by the reference numeral (62). By virtue of being recessed relative to the trailing edge of the fuel air shroud means (46), the exit plane of the primary air shroud means (48) and more specifically the trailing edge of the primary air shroud means (48) is removed as a potential deposition surface of solid fuel particles.

In addition to the foregoing, the primary air shroud means (48) is characterized in a second respect further by the fact that the trailing edge thereof is tapered by a predetermined amount. This predetermined amount of taper, which is depicted in FIG. 3 by the arrows that are each identified by the same reference numeral, i.e., reference numeral (64), is purposely made small enough, i.e., the angle of taper is made small enough, such that neither the fuel air nor the primary air, which are flowing on either side thereof separate from the trailing edge surface of the primary air shroud means (48), which if they did could result in the creation of additional, unwanted recirculation.

Continuing with the description of the nature of the construction and mode of operation of the primary air shroud means (48), as best understood with reference to FIG. 4 of the drawing the primary air shroud means (48) is characterized in a third respect additionally by the fact that the primary air shroud means (48) is also provided with rounded corners, denoted therein by the reference numeral (66). More specifically, each of the rounded corners (66) of the primary air shroud means (48) is made to embody a second predetermined radius, which for ease of reference is depicted by the arrow that is identified by the reference numeral (68) in FIG. 4 of the drawing. The rounded corners (66) of the primary air shroud means (48) are thus operative to increase velocities in the corners (66) of the primary air shroud means (48) that in turn assist in helping to avoid deposition of solid fuel particles in the corners (66) of the primary air shroud means (48), and in the event such deposition does occur helps in effecting the removal thereof. Furthermore, the rounded exit plane corners (66) of the primary air shroud means (48) coupled with the rounded exit plane corners (58) of the fuel air shroud means (46) operate to provide the first embodiment of MRFC solid fuel nozzle tip (12) with a uniform fuel air flow distribution within the first embodiment of the MRFC solid fuel nozzle tip (12). Namely, uniform spacing exists between the outer surface of the primary air shroud means (48) and the inner surface of the fuel air shroud means (46) throughout the entire space that exists therebetween. For ease of reference this uniform spacing between the inner surface of the fuel air shroud means (46) and the outer surface of the primary air shroud means (48) is depicted in FIG. 4 of the drawing through the use of the arrows that are denoted therein by means of the reference numeral (70). Such uniform fuel air flow distribution within the first embodiment of the MRFC solid fuel nozzle tip (12) in turn provides not only for uniform cooling of the first embodiment of the MRFC solid fuel nozzle tip (12) by the fuel air stream, but also provides for uniform blanketing of the primary air stream by the fuel air stream so that control can thus be exercised both over the point of ignition of the solid fuel and over $NO_X$ emissions.

Next, a description will be had herein of the nature of the construction and the mode of operation of the fuel air shroud support means (50) of the first embodiment of the MRFC solid fuel nozzle tip (12). To this end, the fuel air shroud support means (50) is characterized in a first respect by the fact that the fuel air shroud support means (50) is recessed to a predetermined distance relative to the exit plane of the first embodiment of the MRFC solid fuel nozzle tip (12) so as to keep the recirculation region and vertical deposition surface normally created thereby away from the exit plane of the first embodiment of the MRFC solid fuel nozzle tip (12). The effect of so recessing the fuel air shroud support means (50) relative to the exit plane of the first embodiment of the MRFC solid fuel nozzle tip (12) is to reduce the possible influence that the fuel air shroud support means (50) has on the deposition process. Furthermore, from a structural standpoint recessing the fuel air shroud support means (50) also allows both the trailing edge of the fuel air shroud means (46) and the trailing edge of the primary air shroud means (48) to expand independently of one another thereby reducing the stress that is induced thermally in both the fuel air shroud means (46) and the primary air shroud means (48). The predetermined distance to which the fuel air shroud support means is recessed relative to the exit plane of the first embodiment of the MRFC solid fuel nozzle tip (12) is for ease of understanding depicted in FIG. 3 of the drawing by the arrow identified therein by the reference numeral (72).

Lastly, there will now be set forth herein a description of the nature of the construction and the mode of operation of the splitter plate means (52) of the first embodiment of the MRFC solid fuel nozzle tip (12). The splitter plate means (52) is characterized in a first respect by the fact that the splitter plate means (52), like the primary air shroud means (48) that has been described hereinbefore, is recessed within the exit plane of the fuel air shroud means (46). Moreover, not only is the splitter plate means (52) recessed within the fuel air shroud means (46), but the splitter plate means (52) is also recessed to a predetermined distance relative to the trailing edge of the primary air shroud means (48). To facilitate an understanding thereof, this predetermined distance to which the splitter plate means (52) is recessed relative to the trailing edge of the primary air shroud means (48) is depicted in FIG. 3 by the arrow that is identified therein by the reference numeral (74). By being so recessed the splitter plate means (52) is thereby removed as a surface susceptible to potential deposition arising from the firing zone, i.e., the exit plane of the first embodiment of the MRFC solid fuel nozzle tip (12). Also, such recessing of the splitter plate means (52) is effective for purposes of providing some cooling to the splitter plate means (52) by virtue of the shielding effect provided thereto by the fuel air shroud means (46). In addition, such recessing of the splitter plate means (52) results in a splitter plate means (52) that is shorter in length, which in turn thus has the effect of reducing the contact surface for heat transfer thereto as well as reducing the contact surface for the deposition of particles thereon. In addition, the splitter plate means (52) is also characterized in a second respect by the fact that both ends of the splitter plate means (52) are tapered by a predetermined amount. To facilitate an understanding thereof, the extent to which the ends of the splitter plate means (52) are tapered is depicted in FIG. 3 of the drawing by the arrows that are each identified therein by the reference numeral (76). It should be noted herein that the predetermined amount by which the ends of the splitter plate means (52) are tapered is such that the angle of taper thereof is made small enough to prevent the separation relative thereto of the primary air that flows on either side thereof. If such separation of the primary air were to occur, it could have the effect of creating additional unwanted flow recirculation. Such tapering of the ends of the splitter plate means (52) is effective in reducing the recirculation region that has served to adversely affect the operation of prior art forms of solid fuel nozzle tips, which are characterized by the fact that they embody a blunt faced trailing edge. Secondly, such tapering of the ends of the splitter plate means is effective in reducing the shed vortices that are created by such blunt faced trailing edges. If the splitter plate means (52) were to embody blunt ends, the recirculation region induced thereby would operate to draw hot particulate back thereto and thus would have the effect of creating or exacerbating the solid fuel deposition phenomena. Such a recirculation region is also capable of providing conditions conducive to combustion, thus creating flames within the recirculation region, which would have the effect of raising temperatures and further exacerbating the deposition problem. Moreover, leading edge induced vortices created by blunt faced edges occasion increased turbulence levels within the primary air stream and thus exacerbate solid fuel particulate deposition on such edges, a result that is obviated when tapered edges are employed rather than blunt edges. Although the splitter plate means (52) is illustrated in FIGS. 3 and 4 of the drawing as comprising in accordance with the best mode embodiment of the invention a pair of individual splitter plates spaced equidistantly on either side of the centerline of the first embodiment of the MRFC solid fuel nozzle tip (12), it is to be understood that the splitter plate means (52) could comprise a different number of individual splitter plates without departing from the essence of the present invention.

A description will now be had herein of the nature of the construction of a second embodiment of MRFC solid fuel nozzle tip. For this purpose reference will be had to FIGS. 5 and 6 of the drawing wherein the second embodiment of the MRFC solid fuel nozzle tip is illustrated as being cooperatively associated with the solid fuel nozzle (34). In the interest of differentiating the second embodiment of MRFC solid fuel nozzle tip from the first embodiment of MRFC solid fuel nozzle tip (12) for purposes of the discussion thereof that follows, the second embodiment of MRFC solid fuel nozzle tip is denoted generally in FIGS. 5 and 6 of the drawing by the reference numeral (112). However, any components of the second embodiment of the MRFC solid fuel nozzle tip (112) that are common to the second embodiment of the MRFC solid fuel nozzle tip (112) as well as to the first embodiment of the MRFC solid fuel nozzle tip (12) are identified by the same reference numeral in FIGS. 5 and 6 as that by which they are identified in FIGS. 3 and 4 of the drawing.

Continuing, the second embodiment of the MRFC solid fuel nozzle tip (112) is particularly characterized by the inclusion therewithin of positive means operative to effect a cooling of the primary air shroud means (48) of the second embodiment of the MRFC solid fuel nozzle tip (112). Namely, in certain applications wherein particular types of solid fuel are being combusted the possibility exists that the trailing edge of the primary air shroud means (48) may become sufficiently hot because of heat radiated thereto from the fuel air shroud means (46) to cause melting of the solid fuel as the solid fuel flows through the primary air shroud means (48) whereupon deposition of the melted solid fuel on the trailing edge of the primary air shroud means (48) could occur. Accordingly, for use in such applications it is desirable that a second embodiment of the MRFC solid fuel nozzle tip, i.e., that denoted generally by the reference numeral (112) be provided. More specifically, for use in such applications it is desirable that the first embodiment of the MRFC solid fuel nozzle tip (12) be modified so as to incorporate therewithin cooling means, i.e., that a second embodiment of the MRFC solid fuel nozzle tip (112) be provided, which would be operative to preclude the trailing edge of the primary air shroud means (48) from becoming sufficiently hot from heat radiated thereto from the fuel air shroud means (46) that melting of the solid fuel could otherwise occur as the solid fuel flows through the primary air shroud means (48). To this end, in accordance with the second embodiment of the MRFC solid fuel nozzle tip (112) shielding means are provided suitably interposed between the trailing edge of the primary air shroud means (48) and the trailing edge of the fuel air shroud means (46). Such a shielding means may take either of two forms. In accordance with the first form thereof the shielding means, as best understood with reference to FIG. 5 of the drawing, comprises an "off-set" deflector member, denoted generally therein by the reference numeral (78). The "off-set" deflector member (78) is physically separated from the primary air shroud means (48) so that the "off-set" deflector member (78) effectively cools the primary air shroud means (48) and in particular the trailing edge thereof by acting as a shield between the primary air shroud means (48) and the fuel air shroud means (46) such that radiant heating of the primary air shroud means (48) from the fuel air shroud means (46) is sufficiently minimized to prevent the trailing edge of the primary air shroud means (48) from becoming sufficiently heated that the primary air shroud means (48) becomes hot enough to cause melting of the solid fuel as the solid fuel flows through the primary air shroud means (48). In addition, the "off-set" deflector member is suitably designed so as to be operative to direct a portion of the fuel air, which flows through the space provided for this purpose between the inner surface of the fuel air shroud means (46) and the outer surface of the primary air shroud means (48) towards, in a converging manner thereto, the primary air/solid fuel stream that is exiting from the trailing edge of the primary air shroud means (48). The convergence of this portion of the fuel air with the primary air/solid fuel stream creates turbulence in the area of convergence and enhanced ignition of the solid fuel without the flame resulting from such ignition becoming attached to the second embodiment of the MRFC solid fuel nozzle tip (112).

Figure 6:
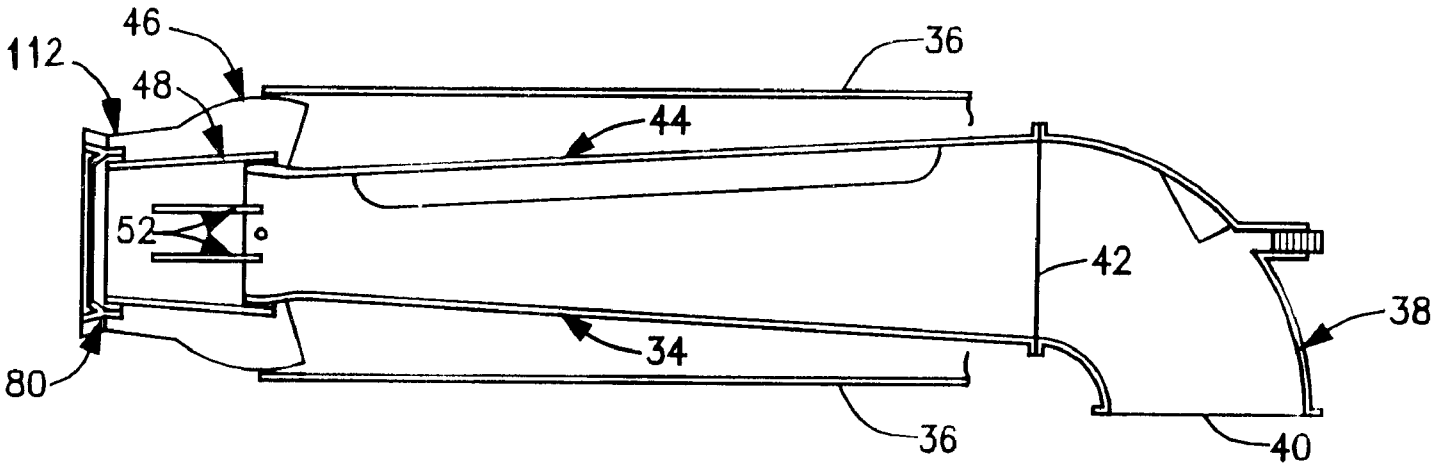
FIG. 6 is a side elevational view of a pulverized solid fuel nozzle, which is illustrated in FIG. 6 as embodying a second form of the second embodiment of a minimum recirculation flame control (MRFC) solid fuel nozzle tip constructed in accordance with the present invention, of the type employed in the firing system of the pulverized solid fuel-fired furnace illustrated in FIG. 1.

For purposes of discussing herein the second form of shielding means that the second embodiment of the MRFC solid fuel nozzle tip (112) may embody, reference will be had to FIG. 6 of the drawing. As best understood with reference to FIG. 6 of the drawing, the second form of shielding means comprises a converging/diverging deflector member, denoted generally therein by the reference numeral (80), that is capable of shielding the primary air shroud means (48) from heat being radiated thereto from the fuel air shroud means (46). At the same time this converging/diverging deflector member (80) is suitably designed so as to be operative to direct a first portion of the fuel air towards, in a converging manner thereto, the primary air/solid fuel stream exiting from the space, which is formed between the inner surface of the fuel air shroud means (48) and the outer surface of the primary air shroud means (46), so as to enable the flow therethrough of the fuel air. The converging/diverging deflector member (80) is further suitably designed so as to be operative to direct a second portion of the fuel air away from, in a diverging manner thereto, the aforereferenced primary air/solid fuel stream. As in the case of the first form of shielding means, the second form of shielding means, i.e., the converging/diverging deflector member (80), also provides for enhanced ignition of low volatile solid fuels without the flame resulting from such ignition attaching to the second embodiment of the MRFC solid fuel nozzle tip (112).

Figure 7:
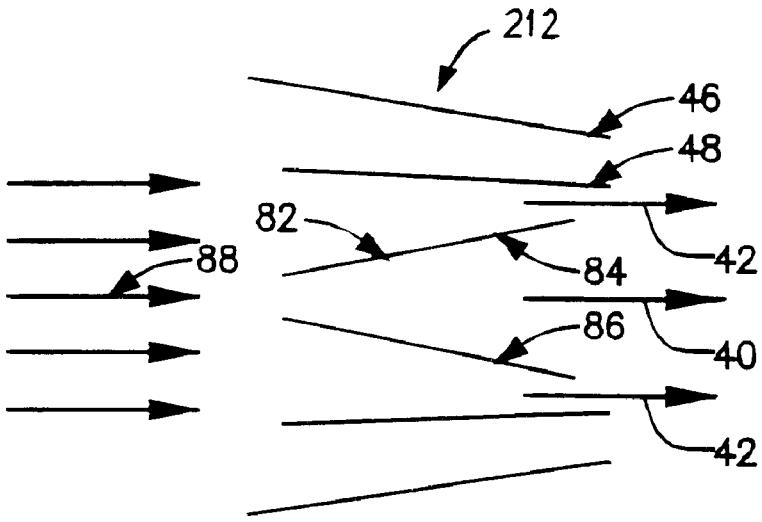
FIG. 7 is a schematic representation of a third embodiment of a minimum recirculation flame control (MRFC) solid fuel nozzle tip constructed in accordance with the present invention.
Figure 8:
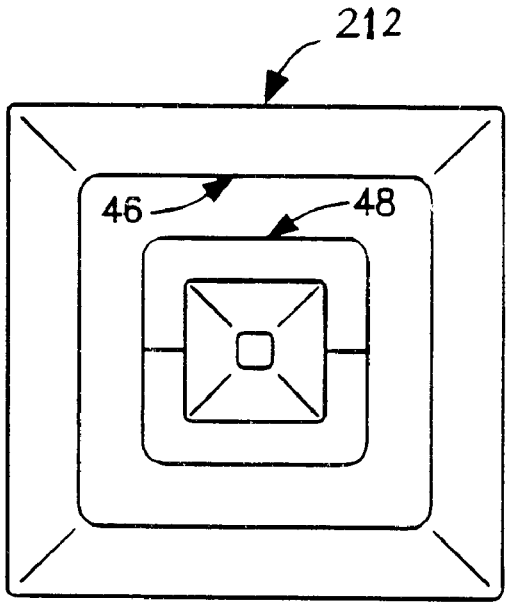
FIG. 8 is an end view of the third embodiment of a minimum recirculation flame control (MRFC) solid fuel nozzle tip constructed in accordance with the present invention.

A description will now be had herein of the nature of the construction and the mode of operation of the third embodiment of the MRFC solid fuel nozzle tip, which for purposes of differentiation from the first embodiment of the MRFC solid fuel nozzle tip (12) and the second embodiment of the MRFC solid fuel nozzle tip (112) is denoted generally in FIGS. 7 and 8 by the reference numeral (212). For purposes of the discussion thereof that follows those components of the third embodiment of the MRFC solid fuel nozzle tip (212), which are common to the third embodiment of the MRFC solid fuel nozzle tip (212) as well as to the second embodiment of the MRFC solid fuel nozzle tip (112) and the first embodiment of the MRFC solid fuel nozzle tip (12) are identified in FIGS. 7 and 8 of the drawing by the same reference numerals that have been employed to identify these components in connection with the illustration thereof in FIGS. 3 and 4 of the drawing and in connection with the illustration thereof in FIGS. 5 and 6 of the drawing. Continuing, the third embodiment of the MRFC solid fuel nozzle tip (212) is characterized in that control of the flame front is capable of being had therewith without resorting to the use of anything that would protrude outwardly of the third embodiment of the MRFC solid fuel nozzle tip (212) and into the burner region (14) of the pulverized solid fuel-firing furnace (10). To this end, the third embodiment of the MRFC solid fuel nozzle tip (212) embodies cone forming means, denoted generally in FIG. 7 by the reference numeral (82). The cone forming means (82) is suitably positioned within the primary air shroud means (48) in supported relation thereto at the exit end of the third embodiment of the MRFC solid fuel nozzle tip (212). In accordance with the best mode embodiment thereof, the cone forming means (82) comprises a modified version of the splitter plate means (52). More specifically, as best understood with reference to FIG. 7 of the drawing the cone forming means (82) comprises a pair of splitter plates, denoted in FIG. 7 by the reference numerals (84) and (86), respectively. The cone forming means (82) is operative for effectuating flame front positioning without the creation of recirculation pockets at the exit end of the third embodiment of the MRFC solid fuel nozzle tip (212), and also without the creation of surface features, which would be susceptible to deposition of solid fuel particles thereon. In addition, the cone forming means (82) is operative to effect ignition of the solid fuel uniformly across the primary air/solid fuel stream. For ease of reference thereto, the primary air/solid fuel stream is depicted in FIG. 7 through the use of a plurality of arrows that are collectively identified therein generally by the reference numeral (88). This uniform ignition of the solid fuel is accomplished by virtue of the fact that a "cone" is created by the cone forming means (82), i.e., by the splitter plates (84) and (86), which is operative to divide the primary air/solid fuel stream into two streams, i.e., the stream denoted by the arrow identified in FIG. 7 by the reference numeral (90) and the stream denoted by the pair of arrows, each identified in FIG. 7 by the reference numeral (92). Each of the streams (90) and (92) are capable of having a different velocity and momentum whereby the third embodiment of the MRFC solid fuel nozzle tip (212) can be made to have a wide range of velocity and momentum values as required for purposes of controlling at the exit end of the third embodiment of the MRFC solid fuel nozzle tip (212) the aerodynamics existing thereat, which in turn influence flame front position and flame characteristics. Generally speaking, the variables that have been used in determining the nature of the cone that is created through the use of the cone forming means (82), i.e., through the use of the splitter plates (84) and (86), are the inlet area of the cone created by the cone forming means (82) as compared to the inlet area of the third embodiment of the MRFC solid fuel nozzle tip (212) and the exit area of the cone created by the cone forming means (82) as compared to the exit area of the third embodiment of the MRFC solid fuel nozzle tip (212). Moreover, if so desired without departing from the essence of the present invention, the cone created by the cone forming means (82) could be made to include mechanisms for imparting swirl to the primary air stream, the fuel air stream or both, and for controlling mixing between the primary air stream and the fuel air stream.

Figure 9:
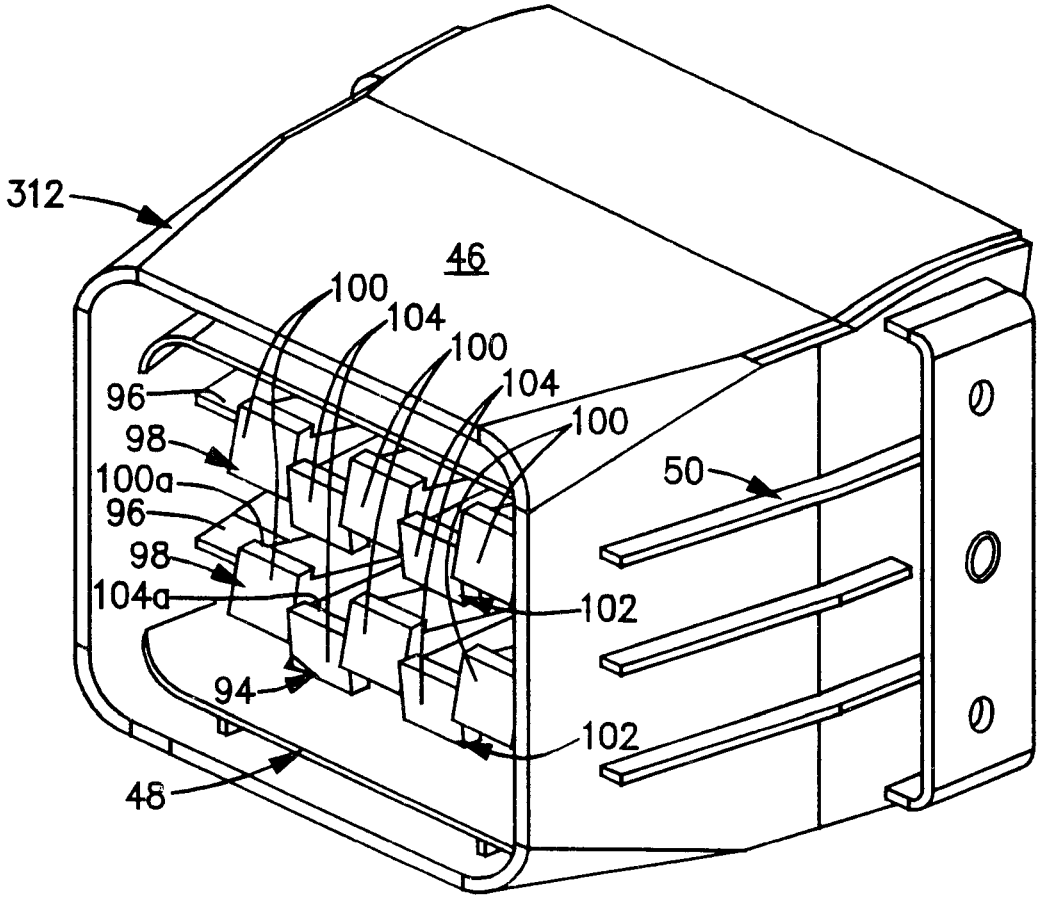
FIG. 9 is a perspective view of a pulverized solid fuel nozzle, which is illustrated in FIG. 9 embodying a fourth embodiment of a minimum recirculation flame control (MRFC) solid fuel nozzle tip constructed in accordance with the present invention, of the type employed in the firing system of the pulverized solid fuel-fired furnace illustrated in FIG. 1.

A description will now be had herein of the nature of the construction and the mode of operation of the fourth embodiment of the MRFC solid fuel nozzle tip, which for purposes of differentiation from the first embodiment of the MRFC solid fuel nozzle tip (12), the second embodiment of the MRFC solid fuel nozzle tip (112) and the third embodiment of the MRFC solid fuel nozzle tip (212) is denoted generally in FIG. 9 by the reference numeral (312). For purposes of the discussion thereof that follows those components of the fourth embodiment of the MRFC solid fuel nozzle tip (312), which are common to the fourth embodiment of the MRFC solid fuel nozzle tip (312) as well as to the third embodiment of the MRFC solid fuel nozzle tip (212), the second embodiment of the MRFC solid fuel nozzle tip (112) and the first embodiment of the FC solid fuel nozzle tip (12) are identified in FIG. 9 of the drawing by the same reference numerals that have been employed to identify these components in connection with the illustration thereof in FIGS. 3 and 4 of the drawing, in connection with the illustration thereof in FIGS. 5 and 6 of the drawing and in connection with the illustration thereof in FIGS. 7 and 8 of the drawing.

Continuing, the fourth embodiment of the MRFC solid fuel nozzle tip (312) is characterized by the inclusion therewithin of low $NO_X$ reduction means, denoted generally in FIG. 9 of the drawing by the reference numeral (94). In accordance with the best mode embodiment thereof, the low $NO_X$ reduction means (94) comprises a modified version of the splitter plate means (52). More specifically, as best understood with reference to FIG. 9 of the drawing the low $NO_X$ reduction means (94) includes a plurality of splitter plates, each identified for ease of reference thereto by the same reference numeral (96) in FIG. 9 of the drawing. Cooperatively associated with each of the plurality of splitter plates (96) is a first set, denoted generally in FIG. 9 by the reference numeral (98), of wedge-shaped bluff bodies, each designated in FIG. 9 by the same reference numeral (100), and a second set, denoted generally in FIG. 9 by the reference numeral (102), of wedge-shaped bluff bodies, each designated in FIG. 9 by the same reference numeral (104).

As will be understood with reference to FIG. 9 of the drawing, the first set (98) of wedge-shaped bluff bodies (100) is cooperatively associated with each of the plurality of splitter plates (96) so as to project, as viewed with reference to FIG. 9, upwardly relative thereto, i.e., so as to project above the centerline of the respective one of the plurality of splitter plates (96). Whereas, the second set (102) of wedge-shaped bluff bodies (104) is cooperatively associated with each of the plurality of splitter plates (96) so as to project, as viewed with reference to FIG. 9, downwardly relative thereto, i.e., so as to project below the centerline of the respective one of the splitter plates (96).

In accordance with the best mode embodiment of the MRFC solid fuel nozzle tip (312) and as will be best understood with reference to FIG. 9 of the drawing, the bluff bodies (100) as well as the bluff bodies (104) are each withdrawn 0.5 to 2.0 inches from both the primary air shroud means (48), which surrounds the solid fuel stream, and the exit plane of the MRFC solid fuel nozzle tip (312) such that the high turbulence region of the solid fuel stream is encased within a low turbulence solid fuel "blanket". Furthermore, the bluff bodies (100) as well as the bluff bodies (104) each embody, as can be seen with reference to FIG. 9, essentially a wedge-shaped configuration with offset appendages, denoted in the case of the bluff bodies (100) each by the reference numeral (100A) and denoted in the case of the bluff bodies (104) each by the reference numeral (104A). The bluff bodies (100) with offset appendages (100A) and the bluff bodies (104) with offset appendages (104A) bear a resemblance in appearance to socalled "pumpkin teeth", i.e., the teeth carved into a pumpkin for Halloween. The effect of the bluff bodies (100) with offset appendages (100A) and the bluff bodies (104) with offset appendages (104A) is to maximize turbulence and vortex shedding while yet maintaining the ability of the MRFC solid fuel nozzle tip (312) to tilt and to direct the solid fuel stream. In accordance with the best mode embodiment of the MRFC solid fuel nozzle tip (312), the offset appendages (100A) and the offset appendages (104A) are each approximately 0.75 to 1.75 inches wide, and are each offset vertically 0.5 to 2.5 inches from each of the offset appendages (100A) or offset appendages (104A) that is adjacent thereto.

Referring again to FIG. 9 to the drawing, as will be best understood with reference thereto the offset appendages (100A) and the offset appendages (104A) are each located at the trailing end of the respective one of the plurality of splitter plates (96), with which the bluff bodies (100) and the bluff bodies (104) are respectively cooperatively associated. Note is further made here of the fact that in accordance with the best mode embodiment of the MRFC solid fuel nozzle tip (312) each of the plurality of splitter plates (96) is 2 to 5 inches shorter in length than the length of the MRFC solid fuel nozzle tip (312).

By virtue of the geometry, which has been described hereinabove, embodied thereby, the low $NO_X$ reduction means (94) is operative to maximize the overall effect of the vortices, which are created, because of the fact that the vortices are not located so close to each other that adjacent vortices cancel one another. Yet the geometry, which has been described hereinabove, of the low $NO_X$ reduction means (94) still enables a maximum number of vortex generating locations to be provided. Therefore, it is possible to produce therewith a flame front, which typically over a range of solid fuel types is located 6 inches to 2 feet from the exit plane of the MRFC solid fuel nozzle tip (312). To thus summarize, the design of the low $NO_X$ reduction means (94) in terms of the number, geometry, size, overlap and location of the bluff bodies (100) and bluff bodies (104) are effective in optimizing the number of "trip points", which are operative to effect the dispersion of the solid fuel jet, i.e., stream, while yet maintaining each of the "trip points" as individually distinct location. The result is that there is thus provided a solid fuel nozzle tip, i.e., the MRFC solid fuel nozzle tip (312), which insofar as the performance thereof is concerned combines low $NO_X$ emissions and low carbon in the flyash with minimal deposition, which in turn results in long service life for the MRFC solid fuel nozzle tip (312).

Figure 10:
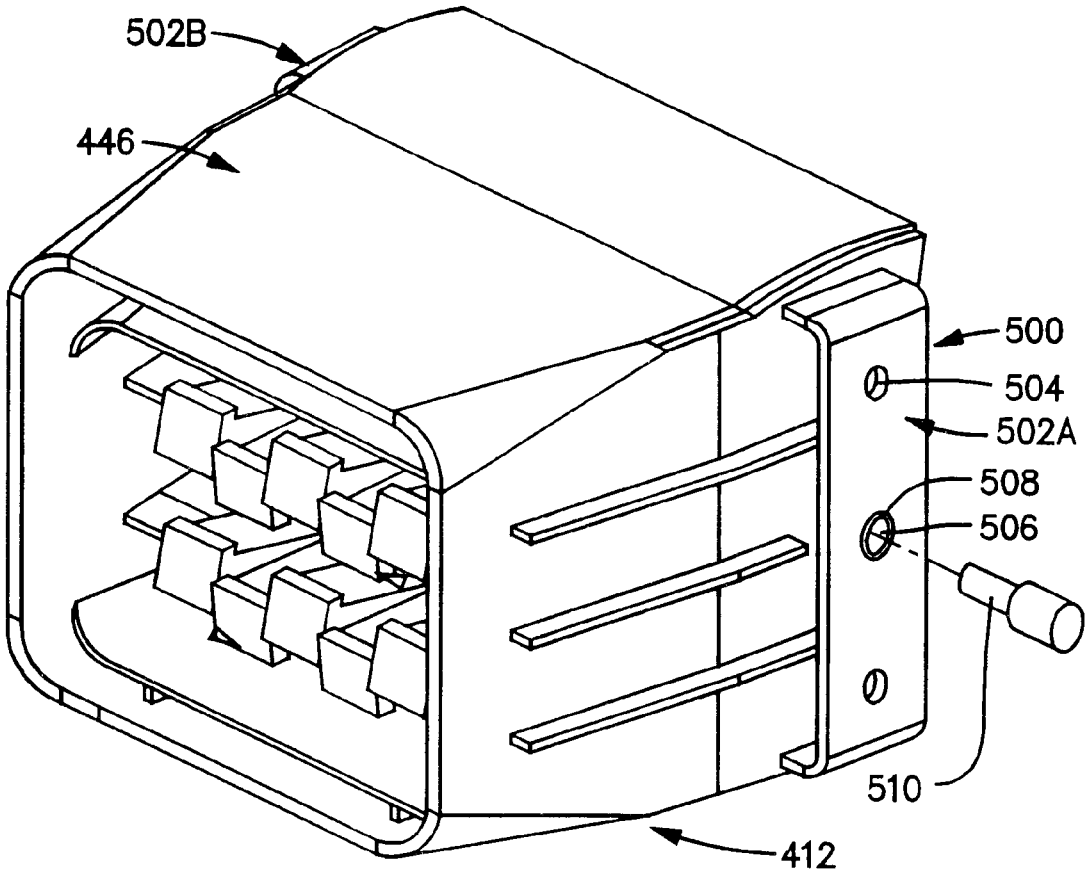
FIG. 10 is a perspective view of a pulverized solid fuel nozzle, which is illustrated in FIG. 10 embodying a fifth embodiment of a solid fuel nozzle tip constructed in accordance with the present invention, of the type employed in the firing system of the pulverized solid fuel-fired furnace illustrated in FIG. 1.

A description will now be had herein of the nature of the construction and the mode of operation of the fifth embodiment of the MRFC solid fuel nozzle tip, which for purposes of differentiation from the first embodiment of the MRFC solid fuel nozzle tip (12), the second embodiment of the MRFC solid fuel nozzle tip (112), the third embodiment of the MRFC solid fuel nozzle tip (212) and the fourth embodiment of the MRFC solid fuel nozzle tip (312), the fifth embodiment of the MRFC solid fuel nozzle tip is denoted generally in FIG. 10 by the reference numeral (412). As seen in FIG. 10, the solid fuel nozzle tip (412) is comprised of ceramics having silicon nitride, siliconized silicon carbide (having a silicon content of between about twenty percent (20%) to sixty percent (60%) by weight, mullite bonded silicon carbide alumina composite, or alumina zirconia composites. In the selection of the ceramic for the solid fuel nozzle tip (412), some ceramics may have a more desirable property in one respect while having a less desirable property in another respect as compared to another ceramic or other ceramics under consideration. Thus, it may not be possible to identify a particular ceramic as significantly more desirable than the other ceramics which may be also suitable for the solid fuel nozzle tip (412). However, to the extent possible, it is desirable that the strength of the ceramic as measured, for example, by a flexural strength test, be relatively high so as to enable the ceramic to more successfully resist deformation. Also, in applications in which the pulverized solid fuel being injected through the solid fuel nozzle tip (412) is itself at a relatively high feed temperature such as, for example, pulverized coal which has been pre-heated, or in applications in which the solid fuel nozzle tip (412) is exposed to a relatively high temperature at its outlet such as, for example, an application in which the solid fuel nozzle tip (412) is mounted in a windbox of a pulverized coal fuel-firing furnace, it may be particularly desirable to select a ceramic which has a good resistance to thermal shock. A ceramic having a good resistance to thermal shock may be characterized, for example, by a high thermal conductivity and a low coefficient of thermal expansion.

One advantage of composing the solid fuel nozzle tip (412) of a ceramic material of the group of ceramic materials comprised of ceramics having silicon nitride, siliconized silicon carbide (having a silicon content of between about twenty percent (20%) to sixty percent (60%) by weight), mullite bonded silicon carbide alumina composite, or alumina zirconia composites is that these ceramics are more likely than other ceramic materials to better tolerate the temperature differentials typically experienced by a pulverized solid fuel nozzle tip. These temperature differentials are the differences in temperature experienced by the pulverized solid fuel nozzle tip within a predetermined period. Relatively rapid or large temperature fluctuations can stress a pulverized solid fuel nozzle tip comprised of ceramic material to failure although, as noted, the ability of the pulverized solid fuel nozzle tip to withstand such stresses can be improved by appropriate selection of the ceramic material.

The pulverized solid fuel nozzle tip (412) is pivotally mounted within a fuel compartment of a pulverized solid fuel combustion facility such as, for example, the fuel compartment (36), by a coal nozzle seal plate assembly (500). The coal nozzle seal plate assembly (500) includes a pair of mounting brackets (502A), (502B) each having a pair of fuel compartment mounting bores (504) and a nozzle tip mounting bore (506). The nozzle tip mounting bore (506) of each mounting bracket (502A), (502B) rotatably supports therein a lever pin boss in the form of a steel bushing (508). A pair of lever pins (510) are secured to the primary air shroud (446) of the pulverized solid fuel nozzle tip (412) each at a respective side wall of the primary shroud on a lateral centerline thereof. Each lever pin (510) is secured as well to a respective one of the bushings.(508). This mounting arrangement for mounting the pulverized solid fuel nozzle tip (412) in a fuel compartment of a pulverized solid fuel combustion facility advantageously assists the pulverized solid fuel nozzle tip to successfully withstand the typical loading imposed on the pulverized solid fuel nozzle tip in its operation including the loading imposed by tilting of the pulverized solid fuel nozzle tip by a conventional nozzle tip tilting mechanism (not shown). The impact resistance and tensile strength of a pulverized solid fuel nozzle tip comprised of ceramic material in accordance with the present invention may not equal that of a conventional stainless steel pulverized solid fuel nozzle tip. For this reason, it is advantageous to accommodate the loading demands imposed on a pulverized solid fuel nozzle tip of the present invention, such as the pulverized solid fuel nozzle tip (412), by, for example, a fuel compartment mounting arrangement such as the mounting arrangement just described. Thus, the lever pins (510) are dimensioned with an adequate thickness such that these lever pins, and the steel bushings (508) in which the lever pins are mounted, operate to distribute the loading of the pulverized solid fuel nozzle tip (412) in an load equalizing manner which reduces the risk that the pulverized solid fuel nozzle tip will catastrophically fail due to loading during tilting of the pulverized solid fuel nozzle tip.

Figure 11:
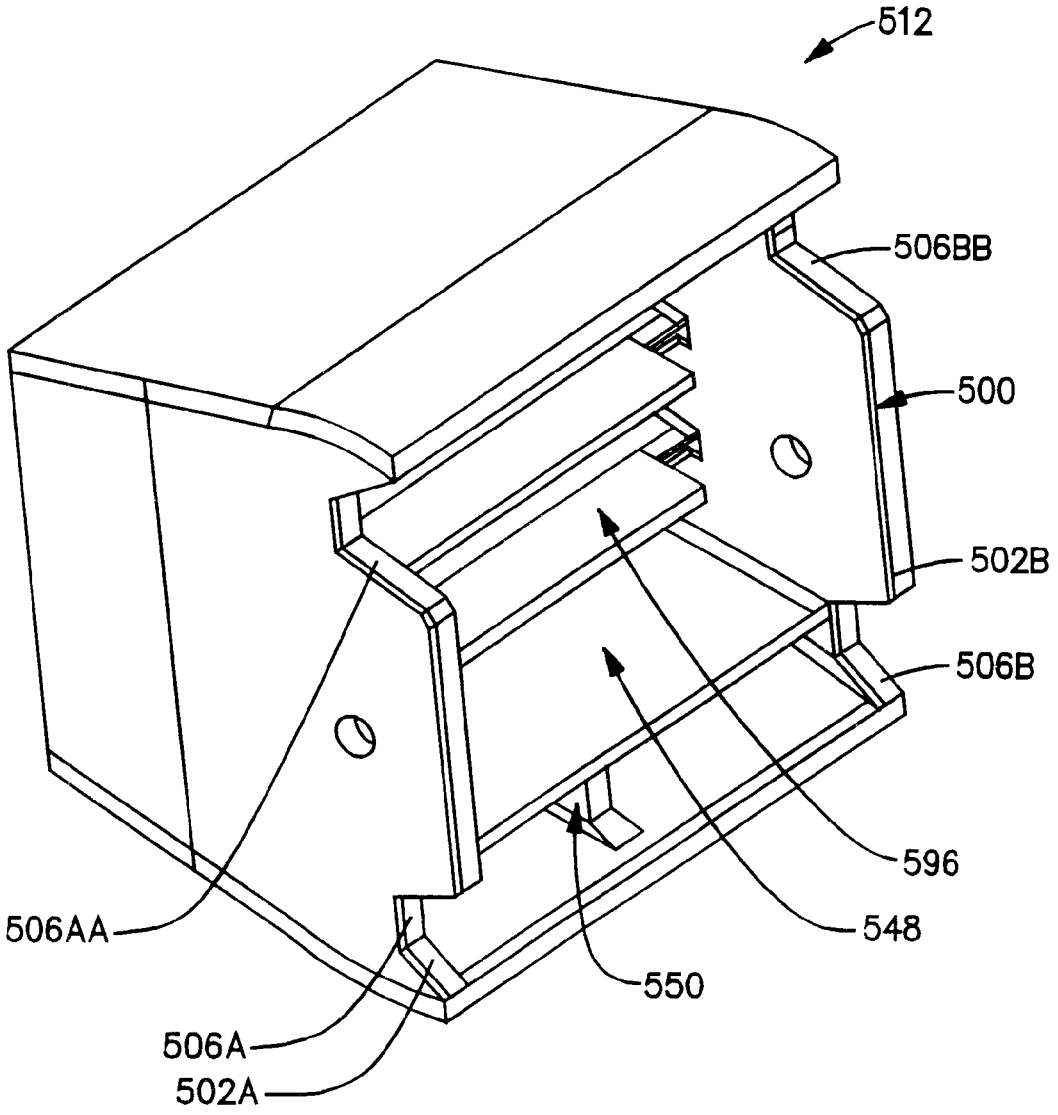
FIG. 11 is a perspective view of a pulverized solid fuel nozzle, which is illustrated in FIG. 11 embodying a sixth embodiment of a solid fuel nozzle tip constructed in accordance with the present invention, of the type employed in the firing system of the pulverized solid fuel-fired furnace illustrated in FIG. 1.
Figure 12:
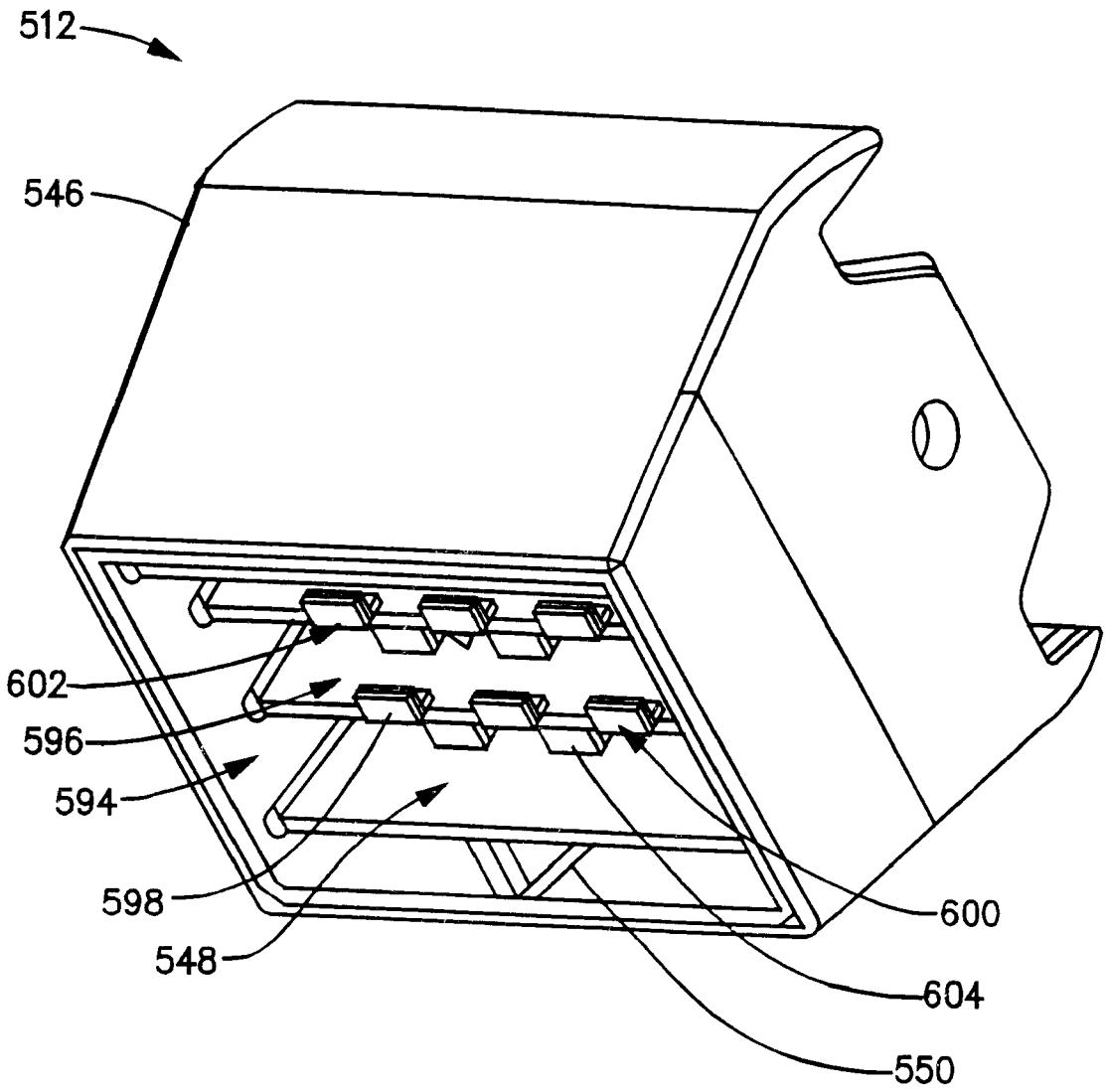
FIG. 12 is another perspective view of the pulverized solid fuel nozzle which is illustrated in FIG. 11 embodying the sixth embodiment of a solid fuel nozzle tip constructed in accordance with the present invention.

A description will now be had herein of the nature of the construction and the mode of operation of the sixth embodiment of the solid fuel nozzle tip, which for purposes of differentiation from the first embodiment of the MRFC solid fuel nozzle tip (12), the second embodiment of the MRFC solid fuel nozzle tip (112), the third embodiment of the MRFC solid fuel nozzle tip (212) and the fourth embodiment of the MRFC solid fuel nozzle tip (312), and the fifth embodiment of the MRFC solid fuel nozzle tip (412), is denoted generally in FIGS. 11–15 by the reference numeral (512). With particular reference to FIG. 12, the sixth embodiment of solid fuel nozzle tip (512) includes fuel air shroud means, denoted therein generally by the reference numeral (546); primary air shroud means, denoted therein generally by the reference numeral (548); fuel air shroud support means, denoted therein generally by the reference numeral (550); and low $NO_X$ reduction means, denoted therein generally by the reference numeral (594).

The fuel air shroud means (546), as best understood with reference to FIG. 12 of the drawing, embodies at the inlet end thereof a bulbous configuration. The bulbous configuration is operative to minimize the possibility that fuel air will bypass the fuel air shroud means (546), i.e., will not flow through the fuel air shroud means (546) as intended, particularly under tilt conditions, i.e., when the fuel air shroud means (546) is an upwardly tilt position or a downwardly tilt position relative to the centerline of the solid fuel nozzle tip (512). Should fuel air bypass the fuel air shroud means (546) this also has the concomitant effect of adversely impacting the extend to which the fuel air is capable of carrying out the cooling effect on the fuel air shroud means (546) desired therefrom.

The low $NO_X$ reduction means (594) includes a pair of splitter plates, each identified for ease of reference thereto by the same reference numeral (596). Integrally formed with each of the plurality of splitter plates (596) is a first set, denoted generally by the reference numeral (598), of bluff bodies, each designated by the same reference numeral (600), and a second set, denoted generally by the reference numeral (602), of bluff bodies, each designated in by the same reference numeral (604).

The first set (598) of bluff bodies (600) is cooperatively associated with each of the plurality of splitter plates (596) so as to project, as viewed with reference to FIG. 12, upwardly relative thereto, i.e., so as to project above the centerline of the respective one of the plurality of splitter plates (596). In contrast, the second set (602) of bluff bodies (604) is cooperatively associated with each of the plurality of splitter plates (596) so as to project, as viewed with reference to FIG. 12, downwardly relative thereto, i.e., so as to project below the centerline of the respective one of the splitter plates (596).

The bluff bodies (600) as well as the bluff bodies (604) are each withdrawn 0.5 to 2.0 inches from both the primary air shroud means (548), which surrounds the solid fuel stream, and the exit plane of the solid fuel nozzle tip (512) such that the high turbulence region of the solid fuel stream is encased within a low turbulence solid fuel "blanket". The bluff bodies (600) and the bluff bodies (604) bear a resemblance in appearance to so-called "pumpkin teeth", i.e., the teeth carved into a pumpkin for Halloween. The effect of the bluff bodies (600) and the bluff bodies (604) is to maximize turbulence and vortex shedding while yet maintaining the ability of the solid fuel nozzle tip (512) to tilt and to direct the solid fuel stream.

The bluff bodies (600) and the bluff bodies (604) are each formed at the trailing end of a respective one of the plurality of splitter plates (596). Each of the plurality of splitter plates (596) is 2 to 5 inches shorter in length than the length of the solid fuel nozzle tip (512).

The portion of the solid fuel nozzle tip (512) which comprises the splitter plates (596), the first set of bluff bodies (598), and the second set of bluff bodies (602), as well as the other components of the pulverized solid fuel nozzle tip enclosed within either or both the fuel air shroud means (546) and the primary air shroud means (548), is comprised of ceramics having silicon nitride, siliconized silicon carbide (having a silicon content of between about thirty percent (30%) to sixty percent (60%) by weight), mullite bonded silicon carbide alumina composite, or alumina zirconia composites. The solid fuel nozzle tip (512) may be formed as a single unit such as, for example, a single mold cast or may be formed of two or more intermediate ceramic components which are secured to one another.

Figure 13:
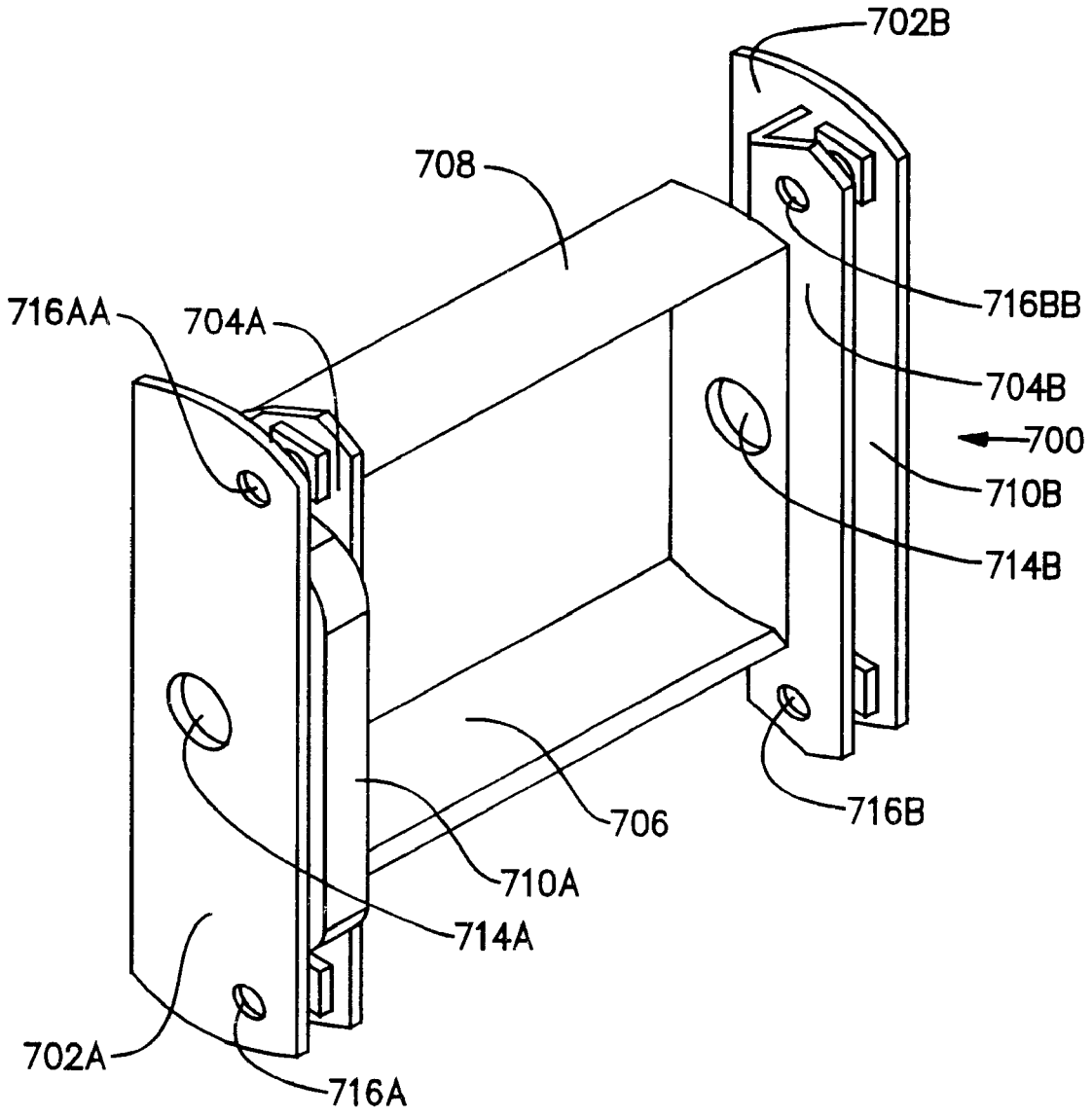
FIG. 13 is a perspective view of a coal nozzle seal plate assembly for mounting the solid fuel nozzle tip illustrated in FIGS. 11 and 12 in the firing system of the pulverized solid fuel-fired furnace illustrated in FIG. 1.
Figure 14:
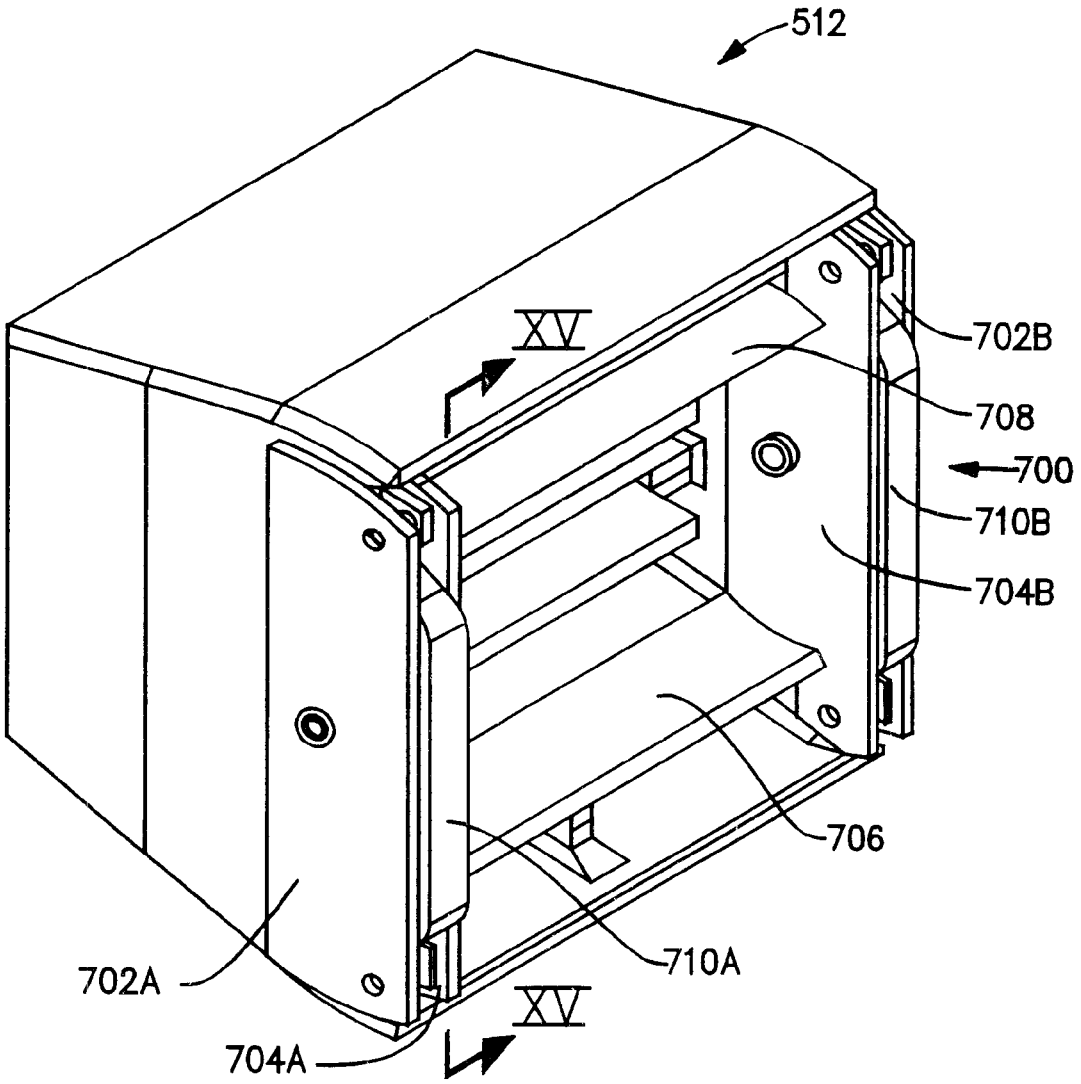
FIG. 14 is a perspective view of the solid fuel nozzle tip illustrated in FIGS. 11 and 12 and the coal nozzle seal plate assembly illustrated in FIG. 13 in their operative nozzle tip assembled conditions in which the coal nozzle seal plate assembly is secured to the solid fuel nozzle tip.
Figure 15:
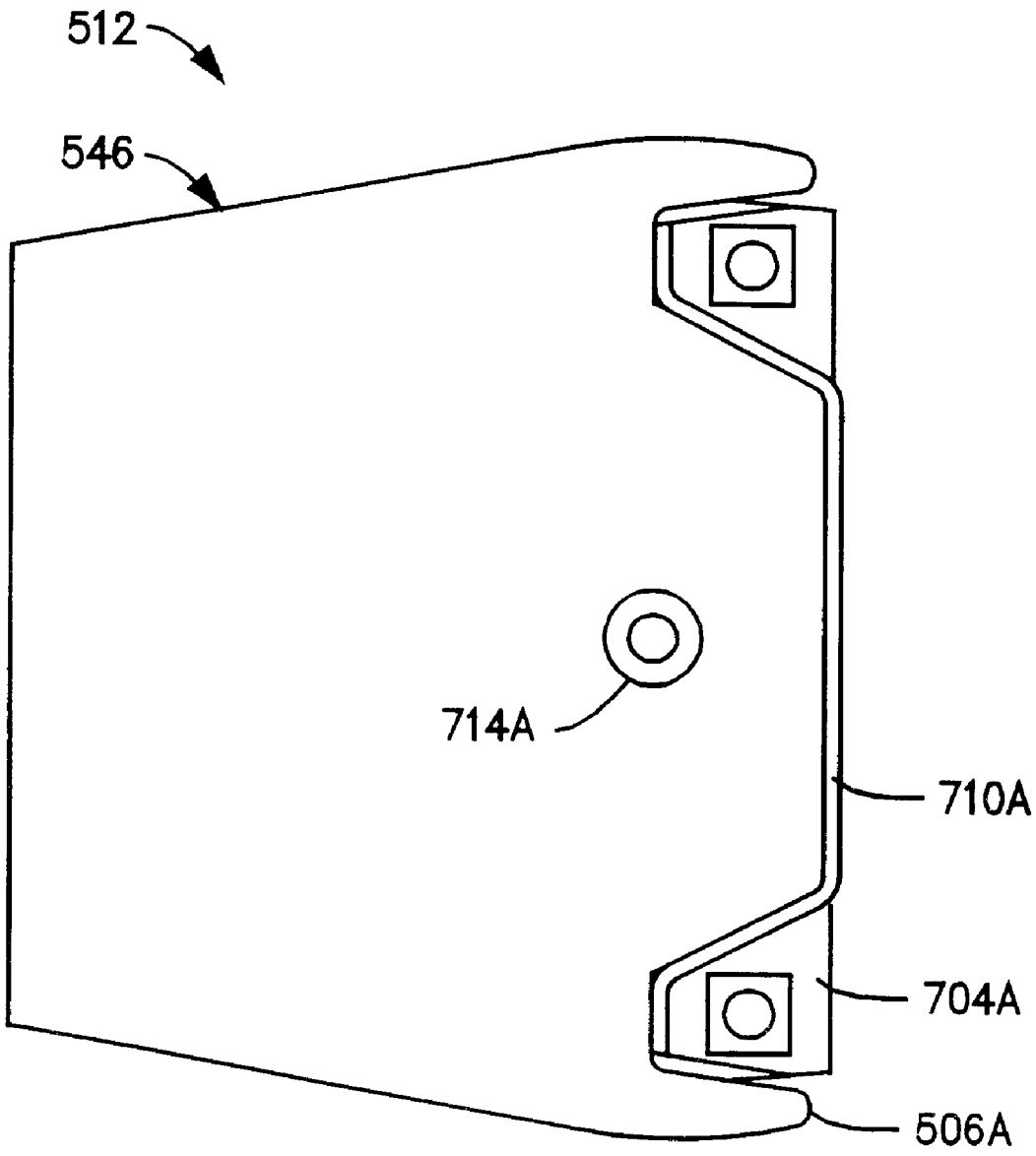
FIG. 15 is a side elevational sectional view, taken along line VX—VX of FIG. 14, of the solid fuel nozzle tip and the coal nozzle seal plate assembly in their operative nozzle tip assembled conditions.

As seen in particular in FIGS. 13, 14, and 15, the pulverized solid fuel nozzle tip (512) is pivotally mounted to the fuel compartment of the pulverized solid fuel combustion facility in which it is deployed such as, for example, the fuel compartment (36) shown in FIG. 2, by means of a coal nozzle seal assembly (700). The pulverized solid fuel nozzle tip (512) and the coal nozzle seal assembly (700) are configured in correspondence with one another, in a manner to be described shortly, such that the loading imposed on the pulverized solid fuel nozzle tip (512) during its operation including, in particular, during the tilting movement of the pulverized solid fuel nozzle tip, is advantageously distributed over an greater extent of the pulverized solid fuel nozzle tip than would otherwise occur if the pulverized solid fuel nozzle tip were instead to be mounted to the fuel compartment by a conventional pivotal mounting arrangement which engaged the pulverized solid fuel nozzle tip only at two pivot mounting bores each disposed on a respective opposed side wall of the primary air shroud means on a lateral centerline of the primary air shroud means. As best seen in FIG. 13, the coal nozzle seal assembly (700) includes a pair of outer lateral brackets (702A), (702B), a pair of inner lateral brackets (704A), (704B), a pair of seal blades (706), (708), and a pair of contoured braces (710A), (710B). The seal blades (706), (708) extend in spaced parallel relation to one another laterally between the pair of inner lateral brackets (704A), (704B) and are secured at their ends to the inner lateral brackets (704A), (704B). The outer lateral bracket (702A) is secured to the inner lateral bracket (704A) at a laterally outward spacing therefrom. The contoured brace (710A) secured between the outer lateral bracket (702A) and the inner lateral bracket (704A). The outer lateral bracket (702B) is secured to the inner lateral bracket (704B) at a laterally outward spacing therefrom. The contoured brace (710B) secured between the outer lateral bracket (702B) and the inner lateral bracket (704B).

As seen in FIG. 11, the pulverized solid fuel nozzle tip (512) has a pair of contoured back surfaces (502A), (502B) and a pair of pivot mounting bores (504A), (504B). The contoured back surfaces (502A), (502B) each define a pair of heightwise spaced recesses (506A), (506AA) and (506B), (506BB), respectively. The contoured braces (710A), (710B) of the coal nozzle seal assembly (700) are each configured, as best seen in FIG. 15, with a pair of heightwise spaced nose portions (712A), (712AA) and (712B), (712BB), respectively, and the contoured braces (710A), (710B) are dimensioned in correspondence with the contoured back surfaces (502A), (502B) of the pulverized solid fuel nozzle tip (512) such that, upon assembly of the coal nozzle seal assembly (700) into its support position on the back side of the pulverized solid fuel nozzle tip (512), the nose portions (712A), (712AA) of the contoured brace (710A) are seated within the recesses (506A), (506AA) and the nose portions (712B), (712BB) of the contoured brace (710B) are seated within the recesses (506B), (506BB). Also, in the support position of the coal nozzle seal assembly (700) on the pulverized solid fuel nozzle tip (512), each one of a pair of center bores (714A), (714B) of the coal nozzle seal assembly (700) is aligned with a pivot mounting bore (508A), (508B), respectively, of the pulverized solid fuel nozzle tip (512) whereupon lever pins (not shown) can be inserted into the two pairs of aligned center bores (714A), (714B) and pivot mounting bores (508A), (508B) and secured to the primary air shroud means (546) and the coal nozzle seal assembly (700). The lever pins are rotatably seated in conventional bores (not shown) in the fuel compartment such that the pulverized solid fuel nozzle tip (512) and the coal nozzle seal assembly (700) pivots as a single unit to thereby permit adjustment of the tilt of the pulverized solid fuel nozzle tip. A pair of bracket interconnecting bores (716A), (716AA) and (716B), (716BB) are formed on the outer lateral brackets (702A), (702B), respectively, of the coal nozzle seal assembly (700) and adapted to receive bolts (not shown) for fixedly mounting the outer lateral brackets (702A), (702B) to the inner lateral brackets (704A), (704B), respectively.

While several embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. A solid fuel nozzle tip for use in cooperative association with a pulverized solid fuel nozzle of a firing system of a pulverized solid fuel-fired furnace comprising:

a. fuel air shroud means mountable in supported relation thereto at one end of the pulverized solid fuel nozzle, said fuel air shroud means having an inlet end and an outlet end, said fuel air shroud being comprised of at least one of the group of ceramics including silicon nitride, siliconized silicon carbide having a silicon content of between about thirty percent (30%) to sixty percent (60%) by weight, mullite bonded silicon carbide alumina composite, and alumina zirconia composites; and b. primary air shroud means mounted in supported relation within said fuel air shroud means; and c. splitter plate means includes a trailing edge and a leading edge, said trailing edge of said splitter plate means being tapered at a small enough angle to avoid separation of air flowing over said splitter plate means while yet remaining operative to reduce the recirculation region at said trailing edge of said splitter plate means in order to thereby minimize the possibility of solid fuel deposition occurring thereat.

2. The solid fuel nozzle tip as set forth in claim 1 wherein said splitter plate means comprises cone forming means operative for effecting control over flame front positioning without the creation of recirculation regions at said outlet end of said fuel air shroud means and without the creation of surface features that would be susceptible to deposition of solid fuel particles thereon.

3. The solid fuel nozzle tip as set forth in claim 1 wherein said splitter plate means comprises low $NO_X$ reduction means operative for minimizing $NO_X$ emissions and for minimizing carbon in the flyash.

4. The solid fuel nozzle tip as set forth in claim 3 wherein said low $NO_X$ reduction means includes a plurality of splitter plates mounted in spaced relation one to another in supported relation within said primary air shroud means, and a first set of bluff bodies cooperatively associated with said plurality of splitter plates.

5. A solid fuel nozzle tip for use in cooperative association with a pulverized solid fuel nozzle of a firing system of a pulverized solid fuel-fired furnace comprising:

a. fuel air shroud means mountable in supported relation thereto at one end of the pulverized solid fuel nozzle, said fuel air shroud means having an inlet end and an outlet end, said fuel air shroud being comprised of at least one of the group of ceramics including silicon nitride, siliconized silicon carbide having a silicon content of between about thirty percent (30%) to sixty percent (60%) by weight, mullite bonded silicon carbide alumina composite, and alumina zirconia composites; and b. primary air shroud means mounted in supported relation within said fuel air shroud means; and c. fuel air shroud support means interposed between said fuel air shroud means and said primary air shroud means so as to be operative for effectuating the support of said fuel air shroud means relative to said primary air shroud means, said fuel air shroud support means being recessed from said trailing edge of said primary air shroud means by a predetermined amount sufficient to keep the recirculation region and vertical deposition surface created by said fuel air shroud support means away from said outlet end of said fuel air shroud means so as to thereby reduce the possible influence of said fuel air shroud support means on the deposition process and also sufficient to allow said outlet end of said fuel air shroud means and said trailing edge of said primary air shroud means to independently expand relative to one another thereby reducing thermally induced stress therein.

6. The solid fuel nozzle tip as set forth in claim 5 and further comprising splitter plate means supported in mounted relation thereto within said primary air shroud means, said splitter plate means being recessed from said outlet end of said fuel air shroud means by a predetermined amount sufficient to remove said splitter plate means as a site susceptible to potential deposition thereon of solid fuel particles and sufficient to provide some cooling of said splitter plate means by virtue of the shielding provided thereto by said fuel air shroud means.

7. The solid fuel nozzle tip as set forth in claim 5 wherein said trailing edge of said primary air shroud means is tapered in order to reduce the recirculation region at said trailing edge of said primary air shroud means that might otherwise be operable to draw hot particulate matter back to said trailing edge of said primary air shroud means and thereby exacerbate thereat solid fuel particle deposition.

8. A solid fuel nozzle tip for use in cooperative association with a pulverized solid fuel nozzle of a firing system of a pulverized solid fuel-fired furnace comprising:

primary air shroud means mounted in supported relation within said fuel air shroud means, said primary air shroud means having a leading edge and a trailing edge;

fuel air shroud means mountable in supported relation thereto at one end of the pulverized solid fuel nozzle, said fuel air shroud means having an inlet end and an outlet end, said fuel air shroud being comprised of at least one of the group of ceramics including silicon nitride, siliconized silicon carbide having a silicon content of between about thirty percent (30%) to sixty percent (60%) by weight, mullite bonded silicon carbide alumina composite, and alumina zirconia composites and said fuel air shroud means includes at the inlet end thereof a bulbous configuration, said bulbous configuration being operative for the purpose of minimizing the bypassing of fuel air around said fuel air shroud means particularly when said fuel air shroud means is in a tilt condition and for the purpose of enhancing the cooling effect produced by the flow of fuel air through said fuel air shroud means, said fuel air shroud means also including rounded corners, said rounded corners being operative for the purpose of producing higher velocities in said rounded corners of said fuel air shroud means and thereby minimizing low velocity regions on said fuel air shroud means whereat solid fuel deposition could occur;

fuel air shroud support means interposed between said fuel air shroud means and said primary air shroud means so as to be operative for effectuating the support of said fuel air shroud means relative to said primary air shroud means, said fuel air shroud support means being recessed from said trailing edge of said primary air shroud means by a predetermined amount sufficient to keep the recirculation region and vertical deposition surface created by said fuel air shroud support means away from said outlet end of said fuel air shroud means so as to thereby reduce the possible influence of said fuel air shroud support means on the deposition process and also sufficient to allow said outlet end of said fuel air shroud means and said trailing edge of said primary air shroud means to independently expand relative to one another thereby reducing thermally induced stress therein; and splitter plate means supported in mounted relation thereto within said primary air shroud means, said splitter plate means being recessed from said outlet end of said fuel air shroud means by a predetermined amount sufficient to remove said splitter plate means as a site susceptible to potential deposition thereon of solid fuel particles and sufficient to provide some cooling of said splitter plate means by virtue of the shielding provided thereto by said fuel air shroud means and said trailing edge of said primary air shroud means being recessed from said outlet end by a predetermined amount sufficient to remove said trailing edge of said primary air shroud means as a potential surface for solid fuel particles.

* * * * *